US008302443B2

(12) United States Patent
Tsuritani et al.

(10) Patent No.: US 8,302,443 B2
(45) Date of Patent: Nov. 6, 2012

(54) SPRING MANUFACTURING APPARATUS

(75) Inventors: Katsuhide Tsuritani, Osaka (JP); Norihiro Uchida, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 1145 days.

(21) Appl. No.: 12/213,446

(22) Filed: Jun. 19, 2008

(65) Prior Publication Data

US 2008/0314110 A1 Dec. 25, 2008

(30) Foreign Application Priority Data

Jun. 20, 2007 (JP) ..... 2007-163086

(51) Int. Cl.
*B21F 3/02* (2006.01)
*B21C 1/00* (2006.01)

(52) U.S. Cl. ..... 72/145; 72/140; 72/446; 29/33 F

(58) Field of Classification Search ..... 72/135, 72/140, 145, 129–132, 442, 446; 29/33 F
See application file for complete search history.

(56) References Cited

U.S. PATENT DOCUMENTS

| | | | | |
|---|---|---|---|---|
| 5,937,685 | A * | 8/1999 | Matsuoka et al. | 72/137 |
| 6,142,002 | A * | 11/2000 | Itaya | 72/137 |
| 6,151,942 | A * | 11/2000 | Itaya | 72/137 |
| 6,185,981 | B1 * | 2/2001 | Chen | 72/135 |
| 6,243,947 | B1 * | 6/2001 | Fujita et al. | 29/33 F |
| 7,134,305 | B2 | 11/2006 | Wu et al. | |
| 2005/0023317 | A1 | 2/2005 | Tsuritani | |
| 2006/0053853 | A1 * | 3/2006 | Wu | 72/137 |
| 2008/0302155 | A1 * | 12/2008 | Tsuritani | 72/135 |

FOREIGN PATENT DOCUMENTS

| | | | |
|---|---|---|---|
| JP | 10-109133 | A | 4/1998 |
| JP | 2000-061736 | A | 2/2000 |
| JP | 2000-61737 | A | 2/2000 |
| JP | 2005-46867 | A | 2/2005 |
| JP | 2006-095533 | A | 4/2006 |
| JP | 2007-030038 | A | 2/2007 |

* cited by examiner

*Primary Examiner* — Dana Ross
*Assistant Examiner* — Pradeep C Battula
(74) *Attorney, Agent, or Firm* — Birch, Stewart, Kolasch & Birch, LLP

(57) ABSTRACT

A spring manufacturing apparatus includes a supporting body which moves in X, Y, and Z-axes directions of a XYZ orthogonal coordinate system representing a moving direction of a wire rod fed from a wire rod feeding unit as a Z-axis. The supporting body is formed with an opening in which the quill is arranged. The supporting body further includes a tool holder for holding a processing tool for processing the wire rod to a spring. The supporting body arranged at the vicinity of the quill is moved to accurately adjust the relative position of the quill and the processing tool, thereby manufacturing a desired spring.

1 Claim, 34 Drawing Sheets

SPRING MANUFACTURING APPARATUS

CROSS-REFERENCE OF RELATED APPLICATIONS

This Nonprovisional application claims priority under 35 U.S.C. §119(a) on Patent Application No. 2007-163086 filed in Japan on Jun. 20, 2007, the entire contents of which are hereby incorporated by reference.

BACKGROUND

1. Field of the Invention

The present invention relates to a spring manufacturing apparatus capable of manufacturing a spring with good precision, in particular to a spring manufacturing apparatus capable of manufacturing a spring with good precision by moving a processing tool for processing a wire rod to a spring, instead of moving the wire rod feeding unit, in at least one direction of XYZ orthogonal three-axes directions in which a moving region of the wire rod fed from a wire rod feeding unit is represented as a Z axis.

2. Description of Related Art

Generally, a quill type spring manufacturing apparatus includes a wire rod feeding unit with a wire rod feeding roller for feeding a wire rod, a semi-circular column shaped quill including a guide path for guiding the wire rod fed from the wire rod feeding unit at an axial core portion thereof, and a holding member for holding a processing tool for processing the wire rod fed from a tip of the quill, wherein a coil spring, a torsion spring and the like are formed by bringing the wire rod into contact with the processing tool held by the holding member. In order to form the wire rod into a desired spring shape, the relative position of the quill and the processing tool needs to be accurately adjusted.

A conventional quill type spring manufacturing apparatus is provided with a wire rod feeding unit having a slide member slidably movable in the XYZ orthogonal three-axes directions in which the moving region of the wire rod fed from the wire rod feeding unit is represented as the Z-axis, or in the X-axis direction and the Y-axis direction. The quill type spring manufacturing apparatus adjusts the relative position of the quill and the processing tool by moving the wire rod feeding unit and the quill to process the wire rod (Japanese Patent Application Laid-Open No. 2006-95533).

In another conventional quill type spring manufacturing apparatus, a movable member which moves in the XYZ orthogonal three-axes directions is arranged facing the quill. This quill type spring manufacturing apparatus adjusts the relative position of the quill and the processing tool by attaching the processing tool to the movable member and moving the tool, (Japanese Patent Application Laid-Open No. 10-109133).

In another conventional quill type spring manufacturing apparatus, two turrets are respectively arranged on two movable tables which move in the XYZ orthogonal three-axes directions, and a plurality of tool holders for holding the processing tool are radially arranged on the turret (Japanese Patent Application Laid-Open No. 2000-61736). This quill type spring manufacturing apparatus has a quill arranged between two movable tables, and the relative position of the processing tool selected by the rotation of the turret and the quill is adjusted by moving the movable table (Japanese Patent Application Laid-Open No. 2000-61736).

SUMMARY

When the processing tool is brought into contact with the wire rod, reactive force involved in processing propagates to the wire rod feeding unit through the wire rod. The spring manufacturing apparatus disclosed in Japanese Patent Application Laid-Open No. 2006-95533 has a structure in which a moving mechanism for the XYZ orthogonal three-axes directions, a twist mechanism for rotating the wire rod feeding unit to twist the wire rod, and a rotation mechanism for rotating the quill are stacked on the wire rod feeding unit, wherein distortion generates in each mechanism due to the reactive force involved in processing, and the total of the distortion generated in each mechanism becomes the distortion of the entire wire rod feeding unit. The distortion of the entire wire rod feeding unit generates a bias of a non-negligible size for processing of the wire rod, and may interfere the formation of the wire rod into a desired spring shape.

The wire rod processed by the processing tool moves forward with the feeding of the wire rod. The spring manufacturing apparatus disclosed in Japanese Patent Application Laid-Open No. 10-109133 has the movable member arranged facing the quill to block the advancement path where the wire rod is fed through, thereby constraining the range of motion of the processed wire rod by the movable member. Therefore, the shape of the formable spring is limited due to restrictions on the length of the wire rod that can be fed when manufacturing one spring, the folding or the rotation of the wire rod, and the like. The spring manufacturing apparatus results in a large size if the distance between the movable member and the quill is spaced apart in order to avoid such restrictions.

Generally, a spring manufacturing apparatus has a great number of processing tools radially arranged around a quill in order to form the wire rod into a spring of complex shape. The spring manufacturing apparatus disclosed in Japanese Patent Application Laid-Open No. 2000-61736 has two turrets arranged on the left and the right side, respectively, with the quill in between. A great number of turrets need to be arranged around the quill in order to radially arrange a great number of processing tools around the quill, but it is difficult to arrange the great number of turrets around the quill in view of the size of the turret.

Additionally, the spring manufacturing apparatus disclosed in Japanese Patent Application Laid-Open No. 2000-61736 includes two small movable tables. A pair of guide rails with a narrow width is arranged in each movable table. When the processing tool comes into contact with the wire rod, the reactive force and the moment generated by the reactive force concentrate on the movable table on the side arranged with the processing tool which is in contact with the wire rod. Then, the guide rail with a narrow width cannot resist the reactive force and the moment generated by the reactive force. Therefore, the position of each movable table might be biased due to the generated reactive force when the wire rod is processed.

Furthermore, when abutting the two processing tools respectively arranged on the two movable tables in processing the wire rod, the reactive force generated by the processing acts as a force for separating the two movable tables from each other, and thus tends to lower the durability of the movable table.

The present invention is proposed in view of the above, and aims to provide a spring manufacturing apparatus in which an opening is formed in a supporting body including at least one of a movable body which moves in an X-axis direction, a movable body which moves in a Y-axis direction, or a movable body which moves in a Z-axis direction of a XYZ orthogonal coordinate system representing a moving region of a wire rod fed from a wire rod feeding unit as the Z-axis, a quill is arranged in the opening, and a tool holder for holding the processing tool for processing the wire rod to the spring is arranged on the supporting body, so that the supporting body arranged at the vicinity of the quill is moved to accurately adjust the relative position of the quill and the processing tool to manufacture a spring of good precision, and a desired spring is manufactured and miniaturization is achieved while avoiding restrictions on the length of the wire rod that can be fed when manufacturing one spring, the folding or the rotation of the wire rod, and the like, and furthermore, a number of tool holders can be arranged at the vicinity of the quill, and the reactive force generated when the processing tool contacts the wire rod is absorbed by the entire supporting body so that durability of the supporting body is enhanced, and a plurality of tool holders are arranged on the supporting body so that two reactive forces that generate when the two processing tools abut against each other to process the wire rod are canceled out at the supporting body, whereby the position of the supporting body is prevented from being biased.

In the present invention, it is an object to provide a sprig manufacturing apparatus accurately adjusting the relative position of the quill and the processing tool to manufacture a spring of good precision while achieving miniaturization and capable of moving the movable unit in the X-axis (or Y-axis) direction to select a necessary processing tool from the plurality of processing tools attached to one tool holder, by providing a slide for sliding the tool holder towards and away from the quill and means for controlling the movement of the slide and the supporting body, so that the movement of the slide and the movement of the supporting body are cooperatively operated to move the processing tool held on the tool holder at high speed, thereby accurately adjusting the relative position of the quill and the processing tool.

In the present invention, it is an object to provide a spring manufacturing apparatus capable of avoiding a portion of the wire rod processed to a spring from being contact with the processing tool, and preventing the avoided wire rod from contacting the quill, by coupling a plurality of driving sources respectively to the wire rod feeding unit and the quill by means of a transmission member, so that the wire rod feeding unit and the quill are rotated about the axial core of the wire rod to rotate the wire rod, avoiding a portion of the wire rod processed to a spring from being contact with the processing tool, and preventing the avoided wire rod from contacting the quill.

Furthermore, in the present invention, it is an object to provide a spring manufacturing apparatus capable of accurately adjusting the relative position of the quill and the processing tool to manufacture a spring of good precision while achieving miniaturization and capable of moving the movable unit in the X-axis (or Y-axis) direction to select a necessary processing tool from the plurality of processing tools attached to one tool holder, by providing a movable unit that moves in the X-axis direction and the Y-axis direction on the supporting body which moves in the Z-axis direction, and providing a tool holder on the movable unit, while arranging the movable unit and the tool holder on the Y-axis (or X-axis) through the supporting body, to hold plurality of tools in the X-axis (Y-axis) direction at the quill side portion of the tool holder, thereby moving the movable unit and the supporting body arranged at the vicinity of the quill.

In the present invention, it is an object to provide a spring manufacturing apparatus capable of accurately adjusting the relative position of the quill and the processing tool to manufacture a spring of good precision, by coupling a plurality of driving sources respectively to a movable member having two movable members by means of a transmission member, thereby moving each movable member in the X-axis direction or the Y-axis direction.

Moreover, in the present invention, it is an object of the present invention to provide a spring manufacturing apparatus capable of avoiding a portion of the wire rod processed to a spring from contacting the processing tool, and preventing the avoided wire rod from contacting the quill, by coupling a plurality of driving sources respectively to the wire rod feeding unit and the quill by means of a transmission member, thereby rotating the wire rod feeding unit and the quill about the axial core of the wire rod to rotate the wire rod.

A spring manufacturing apparatus according to a first aspect includes a wire rod feeding unit which includes wire rod feeding rollers and feeds a wire rod; a quill which guides the wire rod fed from the wire rod feeding unit; a tool holder holding a processing tool which processes the wire rod to a spring; a supporting body which supports the tool holder and includes at least one of an X-axis movable body which moves in an X-axis direction, a Y-axis movable body which moves in a Y-axis direction, or a Z-axis movable body which moves in a Z-axis direction of a XYZ orthogonal coordinate system representing a moving direction of the wire rod fed from the wire rod feeding unit as the Z-axis; and an opening, formed in the supporting body, in which the quill is arranged.

In the first aspect, the supporting body arranged at the vicinity of the quill is moved to accurately adjust the relative position of the quill and the processing tool, to manufacture a spring of good precision. A desired spring can be manufactured and miniaturization of the spring manufacturing apparatus can be achieved while avoiding restrictions on the length of the wire rod that can be fed when manufacturing one spring, the folding or the rotation of the wire rod, and the like. A number of tool holders can be arranged at the vicinity of the quill. The reactive force generated when the processing tool contacts the wire rod is absorbed by the entire supporting body, so that the durability of the supporting body is enhanced. When a plurality of tool holders are arranged on the supporting body and two processing tools are abutted to process the wire rod, the two reactive forces that are generated act in opposite directions to each other at the supporting body thereby canceling each other out, so that the position of the supporting body is prevented from being biased.

The spring manufacturing apparatus according to a second aspect includes, based on the first aspect, a sliding unit which slides the tool holder towards and away from the quill; and a control unit which controls the slidable movement of the sliding unit and the movement of the supporting body.

In the second aspect, the movements of the sliding unit and the movement of the supporting body are cooperatively operated to move the processing tool held on the tool holder at high speed, accurately adjust the relative position of the quill and the processing tool, to manufacture the spring of satisfactory precision in a short period of time.

The spring manufacturing apparatus according to a third aspect includes, based on the first or the second aspect, a first rotation unit which rotates the wire rod feeding unit about an axial core of the wire rod.

In the third aspect, the wire rod feeding unit is rotated about the axial core to rotate the wire rod, so that the portion of the wire rod processed to a spring is avoided from coming into contact with the processing tool.

The spring manufacturing apparatus according to a fourth aspect includes, based on the third aspect, a second rotation unit which rotates the quill about the axial core of the wire rod.

In the fourth aspect, the quill is rotated about the axial core of the wire rod, so that the processed wire rod is prevented from coming into contact with the quill.

The spring manufacturing apparatus according to a fifth aspect includes, based on the first aspect, an X-axis movable body driving source for driving the X-axis movable body which drives the X-axis movable body to move the supporting body in the X-axis direction.

In the fifth embodiment, the relative position in the X-axis direction of the quill and the processing tool is accurately adjusted, so that a spring of good precision is manufactured in a short period of time.

The spring manufacturing apparatus according to a sixth aspect includes, based on the first aspect, a Y-axis movable body driving source which drives the Y-axis movable body to move the supporting body in the Y-axis direction.

In the sixth embodiment, the relative position in the Y-axis direction of the quill and the processing tool is accurately adjusted, so that a spring of good precision can be manufactured in a short period of time.

The spring manufacturing apparatus according to a seventh aspect includes, based on the first aspect, a Z-axis movable body driving source which drives the Z-axis movable body to move the supporting body in the Z-axis direction.

In the seventh embodiment, the relative position in the Z-axis direction of the quill and the processing tool is accurately adjusted, so that a spring of good precision is manufactured in a short period of time.

A spring manufacturing apparatus according to an eighth aspect includes a wire rod feeding unit which includes wire rod feeding rollers and feeds a wire rod; a quill which guides the wire rod fed from the wire rod feeding unit; a tool holder holding a processing tool which processes the wire rod to a spring; a supporting body which supports the tool holder; an opening, formed in the supporting body, in which the quill is arranged; a supporting body driving source for moving the supporting body in a Z-axis direction of a XYZ orthogonal coordinate system representing a moving direction of the wire rod fed from the wire rod feeding unit as the Z-axis; and a movable unit which is arranged at the vicinity of the opening and which moves in the X-axis direction and the Y-axis direction; wherein the tool holder is arranged on the movable unit.

In the eighth aspect, the movable unit and the supporting body arranged at the vicinity of the quill can be moved to accurately adjust the relative position of the quill and the processing tool. A spring of good precision can be manufactured and miniaturization of the spring manufacturing apparatus can be achieved. Furthermore, the movable unit is moved in the X-axis direction or the Y-axis direction to select a necessary processing tool from the plurality of processing tools attached to one tool holder. Therefore, a member used to select the processing tool, for example, a turret and a driving source for rotating the turret are omitted, and thus the number of tool holders can be reduced.

The spring manufacturing apparatus according to a ninth aspect includes, based on the eighth aspect, a first movable unit driving source which moves the movable unit in the X-axis direction; and a second movable unit driving source which moves the movable unit in the Y-axis direction.

In the ninth aspect, the movable unit is moved in the X-axis direction or the Y-axis direction by the drive of each movable unit driving source, the relative position of the quill and the processing tool is accurately adjusted, and a spring of good precision can be manufactured.

The spring manufacturing apparatus according to a tenth aspect includes, based on the eighth or the ninth aspect, a first rotation unit which rotates the wire rod feeding unit about an axial core of the wire rod, and a second rotation unit which rotates the quill about the axial core of the wire rod.

In the tenth aspect, the wire rod feeding unit and the quill are rotated about the axial core of the wire rod to rotate the wire rod, so that the portion of the wire rod processed to a spring is avoided from contacting the processing tool, and the avoided wire rod is prevented from contacting the quill.

The spring manufacturing apparatus according to an eleventh aspect includes, based on the first, the second, or the tenth aspect, the processing tool including two cutting parts for cutting the wire rod, and the two cutting parts are arranged to be point symmetric about the quill as the center.

In the eleventh aspect, when the two cutting parts are abutted to process the wire rod, two reactive forces that are generated act in opposite directions to each other at the supporting body thereby canceling each other out, so that the position of the supporting body is prevented from being biased.

The above and further objects and features of the invention will more fully be apparent from the following detailed description with accompanying drawings.

DETAILED DESCRIPTION

First Embodiment

Figure 1:
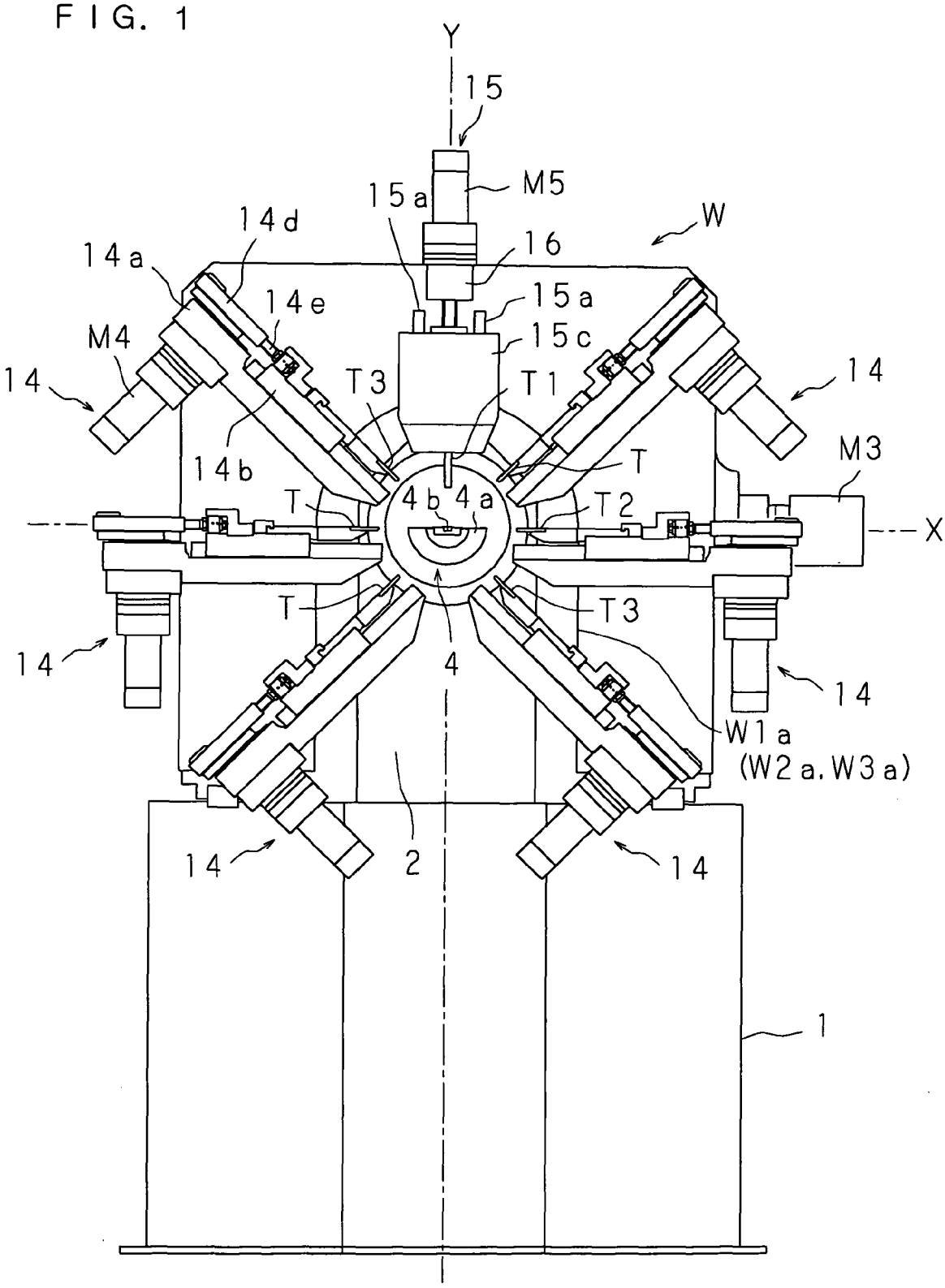
FIG. 1 is a schematic front view of a spring manufacturing apparatus according to a first embodiment.
Figure 2:
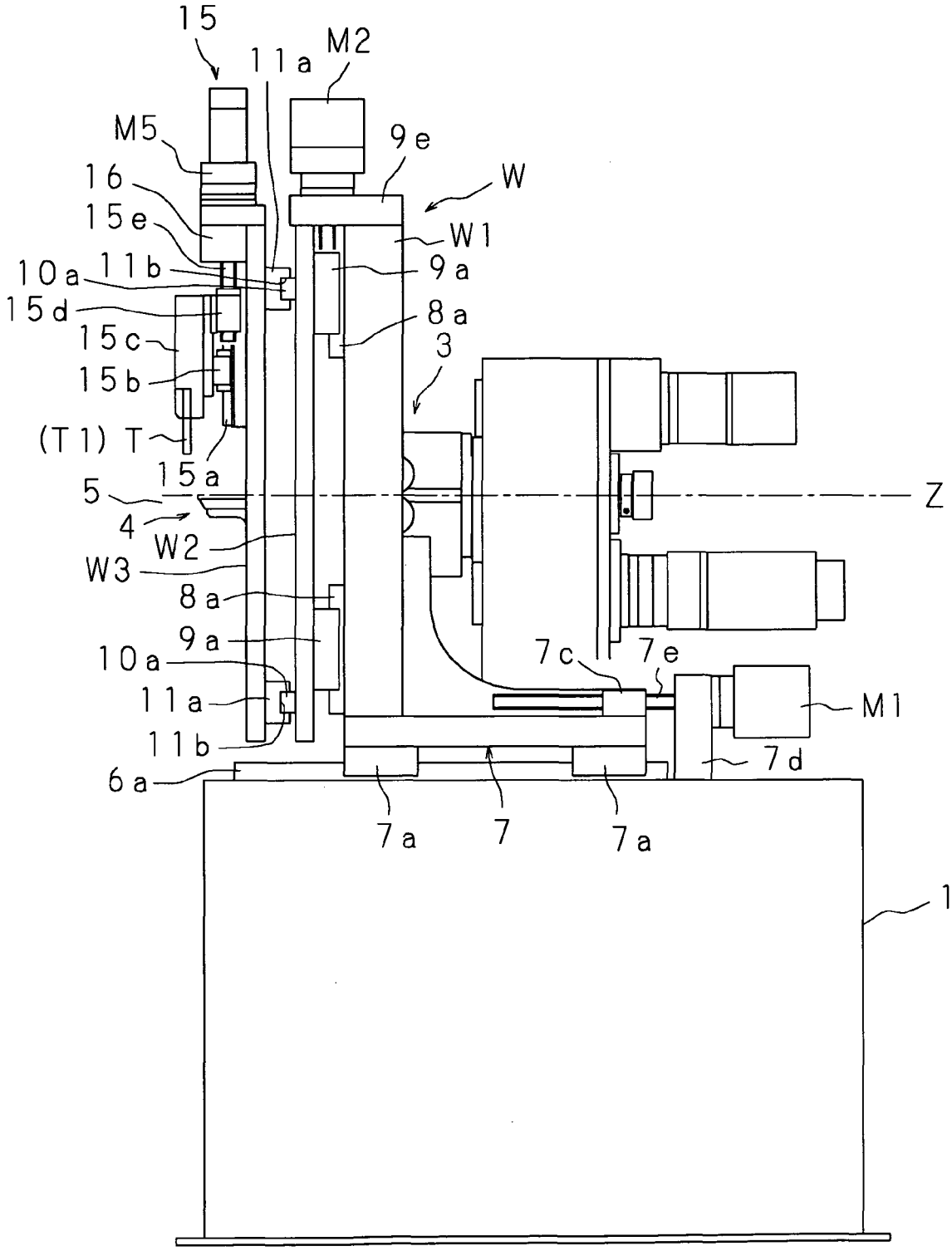
FIG. 2 is a schematic side view of the spring manufacturing apparatus according to the first embodiment.
Figure 3:
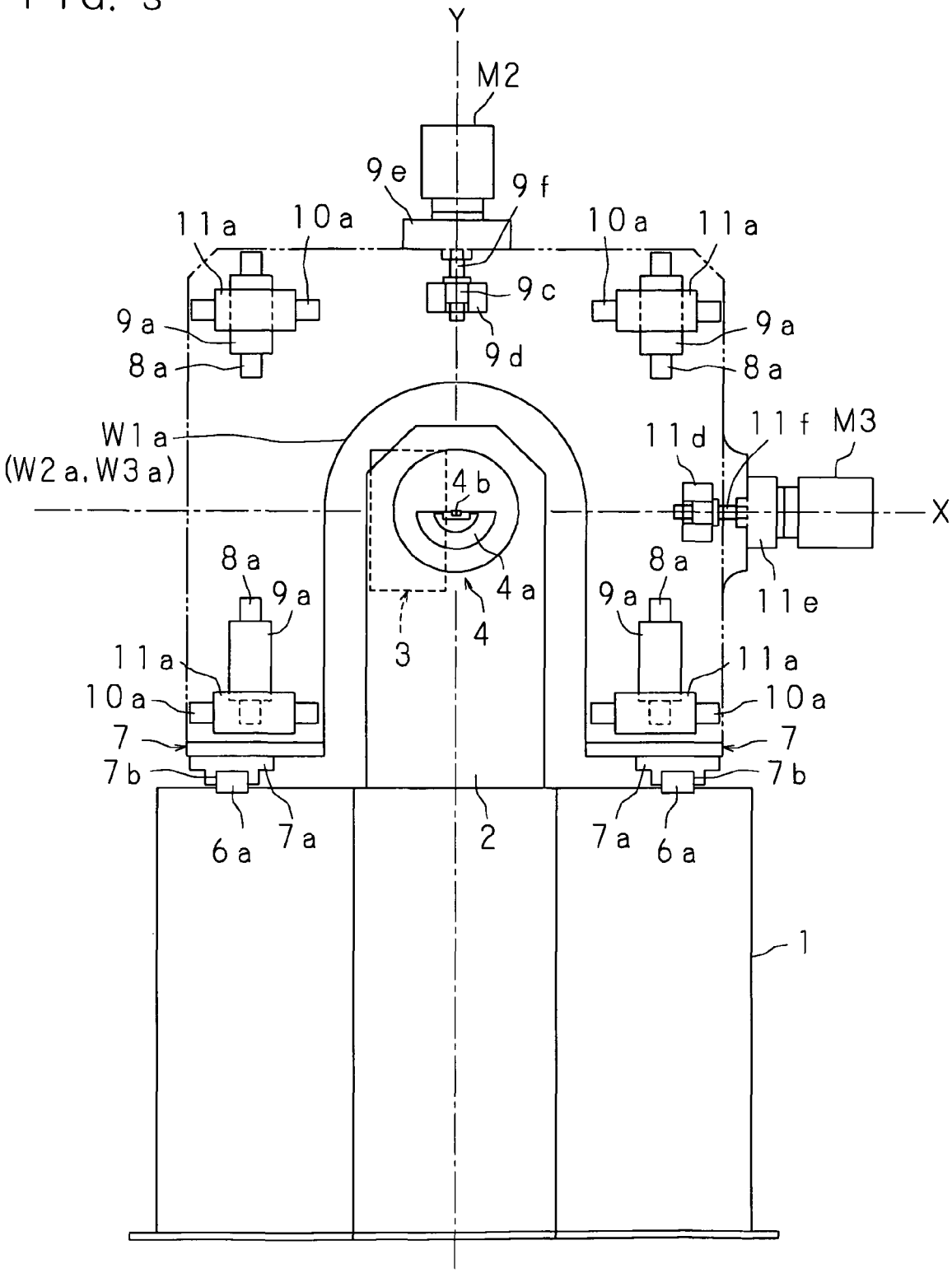
FIG. 3 is a frame format front perspective view showing a sliding member and a rail arranged on a movable plate according to the first embodiment.
Figure 4:
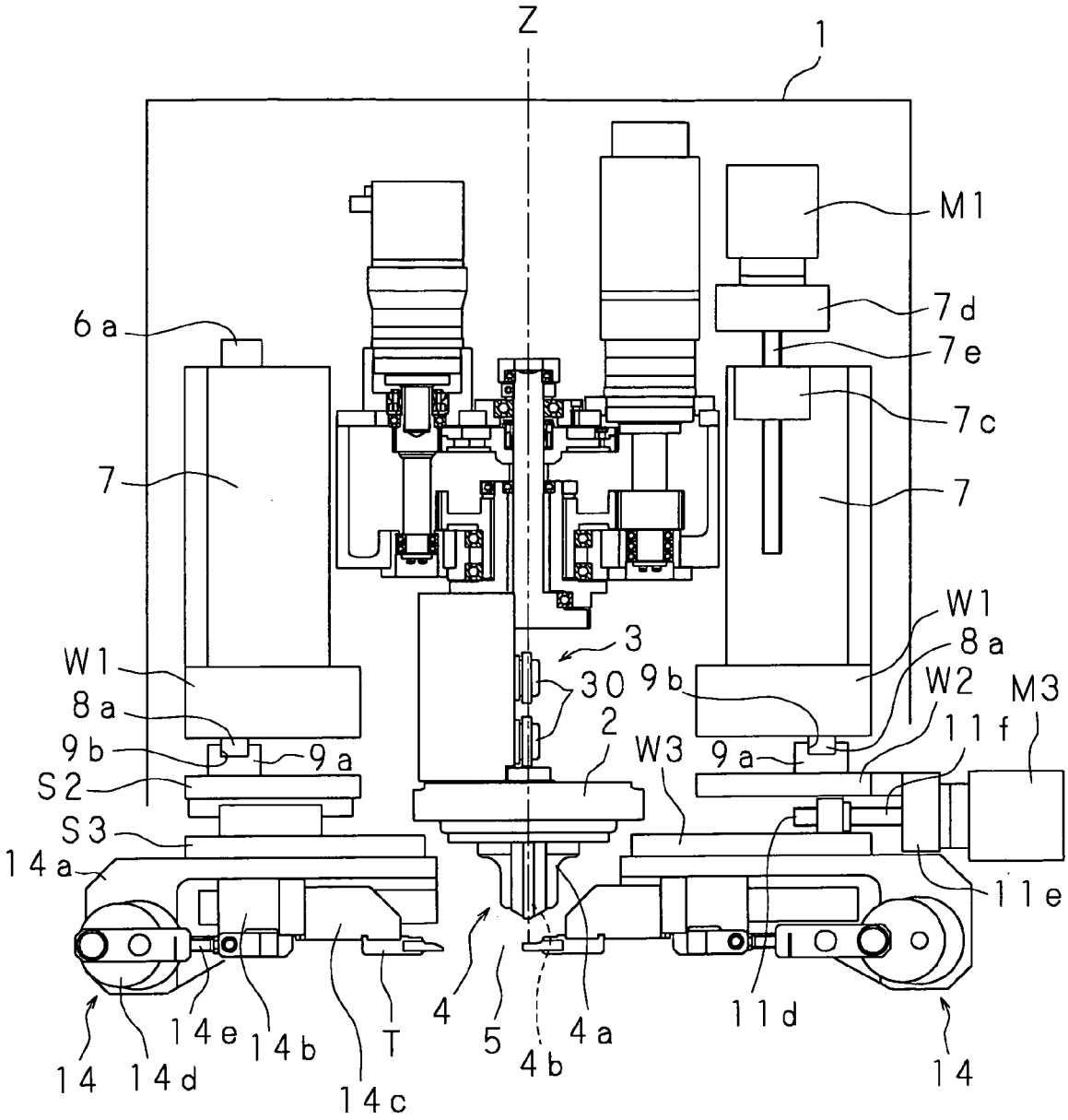
FIG. 4 is a schematic plan partial cross sectional view of the spring manufacturing apparatus according to the first embodiment.

The present invention will be described in detail with reference to drawings showing a spring manufacturing apparatus according to a first embodiment. FIG. 1 is a schematic front view of a spring manufacturing apparatus, FIG. 2 is a schematic side view of the spring manufacturing apparatus, FIG. 3 is a frame format front perspective view showing a sliding member and a rail arranged on a movable plate, and FIG. 4 is a schematic plan partial cross sectional view of the spring manufacturing apparatus.

With reference to the figures, reference numeral 1 is a box shaped base of the spring manufacturing apparatus, wherein a supporting plate 2 for supporting a quill 4 to be hereinafter described is arranged in an upstanding manner on the upper surface of the base 1 near the center towards the front surface face of the base 1. A wire rod feeding unit 3 for feeding the wire rod is arranged on the rear surface side of the supporting plate 2. The wire rod feeding unit 3 includes two pairs of wire rod feeding rollers 30, 30 arranged one above the other, the roller on the upper side is rotated in the clockwise direction and the roller on the lower side is rotated in the counterclockwise direction to feed the wire rod towards the front side while sandwiching the wire rod between the two rollers. A pass-through hole is opened at the portion facing the wire rod feeding unit 3 of the supporting plate 2, and the quill 4 for guiding the wire rod is arranged on the front side of the pass-through hole. The quill 4 includes a semi-circular column shaped body 4*a* and a guide path 4*b*, arranged at the axial core portion of the body 4*a*, for guiding the wire rod.

A bobbin (not shown) wounded with the wire rod to be supplied to the wire rod feeding units 30, 30 is accommodated in the box-shaped base 1. The wire rod is supplied from the bobbin to the wire rod feeding rollers 30, 30 through a capstan (not shown), guided to the quill 4 through the pass-through hole by the wire rod feeding units 30, 30, and fed to a wire rod processing space 5 at the exit of the quill 4 in which the wire rod is processed.

A wall-form supporting body W for supporting tool holders 14*c*, 15*c* for holding the processing tool T to be hereinafter described is arranged at the vicinity of the supporting plate 2. The supporting body W includes movable plates W1, W2, and W3. Two rails 6*a*, 6*a* are laid on both left and right ends of the upper surface of the base 1. The two rails 6*a*, 6*a* are arranged spaced apart by substantially the same distance in the X-axis direction from axial core portion of the fed wire rod the body, in the XYZ orthogonal three-axes representing the axis in the wire feeding direction as the Z-axis, the axis in the left and right direction orthogonal to the Z-axis as the X-axis, and the axis in the up and down direction orthogonal to the Z-axis and the X-axis as the Y-axis.

Two sliding plates 7, 7 are arranged on the rails 6*a*, 6*a*. The sliding plates 7, 7 include a plurality of sliding members 7*a*, 7*a*, . . . (Z-axis movable body) that slide on the rails 6*a*, 6*a* at the positions facing the rails 6*a*, 6*a*. The sliding members 7*a*, 7*a* have a substantially rectangular solid shape, wherein a groove 7*b* is formed on the surface facing the rail 6*a*, 6*a* so that the rail 6*a*, 6*a* is fitted into the groove 7*b* to slide.

A nut part 7*c* is arranged at the upper surface of one of the sliding plates 7, 7, and a block shaped motor fixing part 7*d* is arranged on the upper surface of the base 1 at the back side of the nut part 7*c*. A fit-in hole to which a servo motor M1 (Z-axis movable body driving source) is fitted is formed at the center in the Z-axis direction at the motor fixing part 7*d*. The servo motor M1 capable of forward-reverse rotating is fitted and fixed to the motor fixing part 7*d*, and a male screw 7*e* coupled to a rotation shaft of the servo motor M1 is screwed into the nut part 7*c*. A ball (not shown) is fitted in a rolling manner in a groove portion of the male screw 7*e* and the nut part 7*c*, thereby configuring a ball screw mechanism.

The movable plate W1 is arranged in an upstanding manner across the front part of the two sliding plates 7, 7. An opening W1*a* cutout in an arch shape is opened in the movable plate W1 from the lower center portion from the center part of the movable plate W1. The movable plate W1 is arranged to surround the vicinity of the wire rod feeding unit 3 with the opening W1*a*. The forward-reverse rotation of the servo motor M1 is converted to a translatory movement by the male screw 7*e* and the nut part 7*c*. When the servo motor M1 forward-rotates, the sliding members 7*a*, 7*a*, . . . slide on the rails 6*a*, 6*a*, and the movable plate W1 and the sliding plates 7, 7 move towards the front side along the Z-axis. When the servo motor M1 reverse rotates, the movable plate W1 and the sliding plates 7, 7 move towards the back side along the Z-axis.

Four rails 8*a*, 8*a*, . . . extending in the Y-axis direction are respectively arranged at the four corners of the front surface of the movable plate W1. The movable plate W2 of substantially the same dimension as the movable plate W1 is arranged on the front surface side of the rails 8*a*, 8*a*, . . . . An opening W2*a* cutout in an arch shape is opened in the movable plate W2 from the lower center portion to the center part of the movable plate W2. The movable plate W2 is arranged to surround the vicinity of the supporting plate 2 with the opening W2*a*. The movable plate W2 includes four sliding members 9*a*, 9*a*, . . . (Y-axis movable body) that slide on the rails 8*a*, 8*a* at the positions facing the rails 8*a*, 8*a* . . . . The sliding members 9*a*, 9*a* each has a substantially rectangular solid shape, wherein a groove 9*b* is formed on a face facing the rail 8*a*, 8*a*, . . . so that the rails 8*a*, 8*a*, . . . are fitted into the groove 9*b* to slide.

A block shaped motor fixing part 9*e* for fixing the servo motor M2 (Y-axis movable body driving source) to be hereinafter described is arranged at the center part of the upper surface of the movable plate W1. A fit-in hole to which a servo motor M2 is fitted is formed at the center in the up and down direction at the motor fixing part 9*e*. The movable plate W2 is arranged with a nut part 9*c* and a nut fixing part 9*d* for fixing the nut part 9*c*, in the vicinity of the motor fixing part 9*e*, between the movable plate W1 and the movable plate W2. The servo motor M2 capable of forward-reverse rotation is fitted and fixed to the motor fixing part 9*e*. A male screw 9*f* coupled to a rotation shaft of the servo motor M2 is screwed into the nut part 9*c*. A ball (not shown) is fitted in a rolling manner in a groove portion of the male screw 9*f* and the nut part 9*c*, thereby configuring a ball screw mechanism.

The forward-reverse rotation of the servo motor M2 is converted to a translatory movement by the male screw 9*f* and the nut part 9*c*. When the servo motor M2 forward-rotates, the sliding members 9*a*, 9*a*, . . . slide on the rails 8*a*, 8*a*, and the movable plate W2 moves towards the upper side along the Y axis. When the servo motor M2 reverse-rotates, the movable plate W2 moves towards the lower side along the Y axis.

Four rails 10*a*, 10*a*, . . . extending in parallel to the X-axis direction are respectively arranged at the four corners of the front surface of the movable plate W2. The movable plate W3 of substantially the same dimension as the movable plate W2 is arranged on the front surface side of the rails 10*a*, 10*a*, . . . . An opening W3*a* cutout in an arch shape is opened in the movable plate W3 from the lower center portion to the center part of the movable plate W3. The movable plate W3 is arranged to surround the vicinity of the quill 4 with the opening W3*a*.

The movable plate W3 includes four sliding members 11*a*, 11*a*, . . . (X-axis movable body) that slide on the rails 10*a*, 10*a* at the positions facing the rails 10*a*, 10*a* . . . . The sliding members 11*a*, 11*a* have a substantially rectangular solid shape, wherein a groove 11*b* is formed on a surface facing the rail 10*a*, 10*a*, . . . so that the rails 10*a*, 10*a*, . . . are fitted into the groove 11*b* to slide.

A motor fixing part 11*e* for fixing the servo motor M3 (X-axis movable body driving source) to be hereinafter described is arranged at the center part of the right side of the front surface of the movable plate W2. A fit-in hole to which a servo motor M3 is fitted is formed at the center of the motor fixing part 11*e* penetrating in the left and right direction. The movable plate W3 is arranged with a nut part 11*c* and a nut fixing part 11*d* for fixing the nut part 11*c*, in the vicinity of the motor fixing part 11*e*, between the movable plate W2 and the movable plate W3. The servo motor M3 capable of forward-reverse rotating is fitted and fixed to the motor fixing part 11*e*. A male screw 11*f* coupled to a rotation shaft of the servo motor M3 is screwed into the nut part 11*c*. A ball (not shown) is fitted in a rolling manner in a groove portion of the male screw 11*f* and the nut part 11*c*, thereby configuring a ball screw mechanism.

The forward-reverse rotation of the servo motor M3 is converted to a translatory movement by the male screw 11*f* and the nut part 11*c*. When the servo motor M3 forward-rotates, the sliding members 11*a*, 11*a*, . . . slide on the rails 10*a*, 10*a*, and the movable plate W3 moves towards the right side along the X-axis, facing the front surface. When the servo motor M3 reverse-rotates, the movable plate W3 moves towards the left side along the X-axis, facing the front surface.

Six crank slides (sliding units) 14, 14, . . . for advancing and withdrawing the processing tool T for processing the wire rod with respect to the wire rod processing space 5 are radially arranged with the quill 4 as the center on the front surface of the movable plate W3. The two crank slides 14, 14 are symmetrically arranged on the right and left sides of the quill 4, in the X-axis direction. The four crank slides 14, 14 are respectively arranged inclined at an acute angle upward and downward with respect to the X-axis.

The crank slides 14, 14, . . . fixed on the front surface of the movable plate W3 respectively include a rail board 14*a* with a rail, a plate shaped slider 14*b* that slides on the rail, a tool holder 14*c*, arranged on the slider 14*b*, for holding the processing tool T, a servo motor M4 attached to the rail board 14*a* spaced apart from the slider 14*b*, a crank 14*d* coupled to a rotation shaft of the servo motor M4, and a rod 14*e* arranged between the crank 14*d* and the slider 14*b*.

One end of the rod 14*e* is coupled to the crank 14*d*, and the other end of the rod 14*e* is coupled to the slider 14*b*.

The rotational movement of the servo motor M4 is converted to the translatory movement by the crank 14*d* and the rod 14*e*. The processing tool T held by the tool holder 14*c* advances and withdraws with respect to the wire rod processing space 5 by the converted translatory movement. The two crank slides 14, 14 arranged on the diagonally lower right side and the diagonally lower left side facing the front surface respectively hold two cutters T3, T3 (cutting parts) for cutting the wire rod as the processing tool T. That is, the two cutting parts for cutting the wire rod are arranged to be point symmetric about the quill as the center. The crank slider 14 on the right side of the X-axis holds a folding tool T2 for folding the wire rod as the processing tool T.

A ball screw slide 15 (sliding unit) is arranged on the Y-axis at the upper part of the front surface of the movable plate W3. The ball screw slide 15 advances and withdraws the processing tool T for processing the wire rod with respect to the wire rod processing space 5. The ball screw slide 15 includes two rails 15*a*, 15 arranged side by side along the Y-axis at the upper part of the front surface of the movable plate W3, two sliding members that slide on the rails 15*a*, 15*a*, a tool holder 15*c*, arranged on the sliding member, for holding the processing tool T, a nut part 15*d*, attached to the tool holder 15*c* and arranged between the tool holder 15*c* and the movable plate W3, to which a male screw 15*e* is screwed in, the male screw 15*e* to be screwed into the nut part 15*d*, and a servo motor M5 having a rotation shaft coupled to the male screw 15*e*.

A block shaped motor fixing part 16 for fixing the servo motor M5 is arranged above the tool holder 15*c* at the upper part of the front surface of the movable plate W3. A fit-in hole to which the servo motor M5 is fitted is formed at the center of the motor fixing part 16 penetrating in the up and down direction. The servo motor M5 capable of forward-reverse rotating is fitted and fixed to the motor fixing part 16. A ball (not shown) is fitted in a rolling manner in a groove portion of the male screw 15*e* and the nut part 15*d*, thereby configuring a ball screw mechanism.

The forward-reverse rotation of the servo motor M5 is converted to a translatory movement by the male screw 15*e* and the nut part 15*d*. When the servo motor M5 forward-rotates, the processing tool T held by the tool holder 15*c* advances to the wire rod processing space 5, and when the servo motor M5 reverse-rotates, the processing tool T withdraws from the wire rod processing space 5. A bending dice T1 for bending the wire rod is held by the ball screw slider 15 as the processing tool T, wherein a right winding groove T11 for processing the wire rod into the right winding coil part and a left winding groove T12 for processing the wire rod into the left winding coil part (see FIGS. 11A to 22C to be hereinafter described) are arranged in the bending dice T1.

Figure 5:
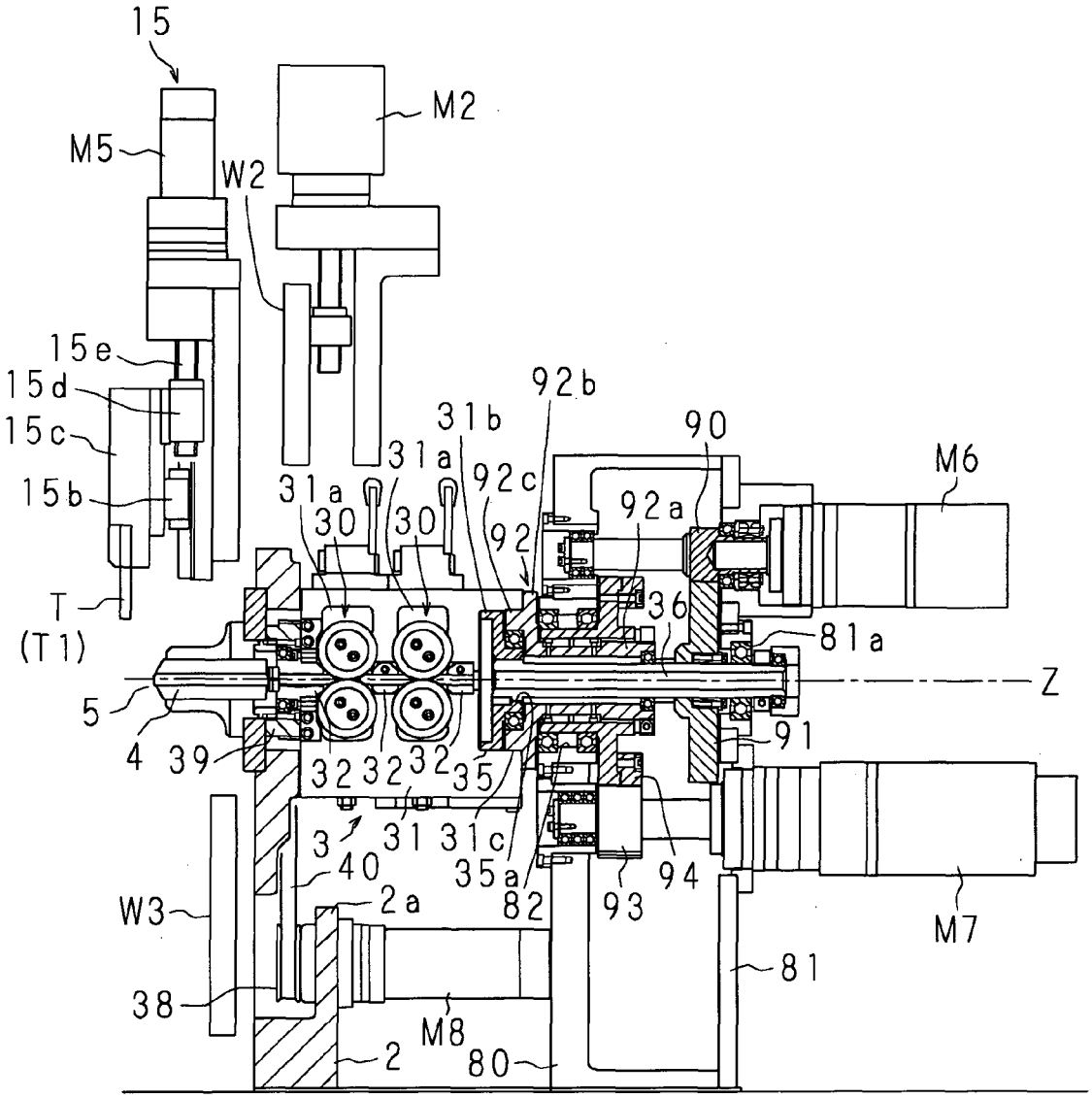
FIG. 5 is a schematic side cross sectional view of the vicinity of a wire rod feeding unit of the spring manufacturing apparatus according to the first embodiment.

FIG. 5 is a schematic side cross sectional view of the vicinity of the wire rod feeding unit of the spring manufacturing apparatus.

An intermediate wall 80 is arranged on the back side of the supporting plate 2, and a rear surface wall 81 is arranged on the back side of the intermediate wall 80. An intermediate hole 82 is opened penetrating the intermediate wall 80, and a hole 81*a* is formed in the rear surface wall 81. The guide path 4*b* of the quill 4, the intermediate hole 82, and the hole 81*a* have a center axis extending in the Z-axis direction.

The wire rod feeding unit 3 is arranged between the supporting plate 2 and the intermediate wall 80. The wire rod feeding unit 3 includes a housing 31, wire rod feeding rollers 30, 30, and a plurality of transmission gears (not shown), accommodated in the housing 31, for transmitting the rotation of the servo motor M6 to be hereinafter described to the wire rod feeding rollers 30, 30.

Two windows 31*a*, 31*a* are opened on the side surface of the housing 31. A pair of upper and lower shafts (not shown) for transmitting the rotation of the transmission gear are extended by an appropriately length to the outer side of the housing 31 from each window 31*a*, 31*a*. The wire rod feeding rollers 30, 30 are arranged along the side surface of the housing 31, and the rollers 30, 30 are coupled to the extended end of each shaft. On the side surface, three guide blocks 32, 32, . . . including a groove for guiding the wire rod are arranged between the wire rod feeding rollers 30, 30, on the upstream side and the downstream side. A fit-in hole 31*c* to be fitted with a fit-in part 92*c* to be hereinafter described is opened on the rear surface of the housing 31.

An annular gear 35 having a fit-in hole 35*a* to which a path cylindrical 36 is fitted at the center is arranged on the back part of the housing 31. A back window 31*b* is formed on the back part of the side surface of the housing 31, wherein the annular gear 35 is exposed from the back window 31*b*. The annular gear 35 is arranged with the center axis extending in the Z-axis direction. The annular gear 35 meshes the transmission gear, so that the rotation of the annular gear 35 is transmitted to the transmission gear.

One end of the path cylinder 36 through which the wire rod passes is fitted into the fit-in hole 35*a*. The path cylinder 36 is inserted to the intermediate hole 82, and the other end of the path cylinder 36 is fitted into the hole 81*a* through a bearing.

A driven gear 91 to be meshed with a main driving gear 90 to be hereinafter described is externally fitted near the other end of the path cylinder 36 between the intermediate wall 80 and the rear surface wall 81. The servo motor M6 is attached to the rear surface wall 81 on the upper side of the path cylinder 36. The axial core of the servo motor M6 is fitted to the main driving gear 90, and the main driving gear 90 is meshed with the driven gear 91. The rotation of the servo motor M6 is transmitted to the driven gear 91 through the main driving gear 90 thereby rotating the path cylinder 36.

The path cylinder 36 rotates by the rotation of the servo motor M6, whereby the annular gear 35 fitted with the path cylinder 36 is rotated. The wire rod feeding rollers 30, 30 are rotated through the transmission gear to feed the wire rod.

A hub 92 for transmitting the rotation of a servo motor M7 to be hereinafter described to the housing 31 is arranged on the rear surface of the housing 31. The hub 92 includes a cylindrical part 92*a*, a collar part 92*b* continuing to one end of the cylindrical part 92*a*, and a fit-in part 92*c*, raised on the side opposite to the cylindrical part 92 from the collar part 92*b*, to be fitted to the fit-in hole 31*c* of the housing 31. The fit-in part 92*c* is fitted to the fit-in hole 31*c*, and the collar part 92*b* is closely attached to the rear surface of the housing 31. The cylindrical part 92*a* is externally fitted to the path cylinder 36 in a freely rotating manner through a bearing, and inserted to the intermediate hole 82.

The driven gear 94 is externally fitted to the cylinder 92*a*. The driven gear 94 includes a gear part and a boss part projecting to one surface side. The boss part is externally fitted to the cylinder 92*a*, and is rotatably supported in the intermediate hole 82 through a bearing. The gear part is arranged on the intermediate wall 80 side between the intermediate wall 80 and the rear surface wall 81.

The servo motor M7 (first rotation unit) is attached to the rear surface wall 81 at the lower side of the path cylinder 36. The main driving gear 93 that meshes the driven gear 94 is fitted to the axial core of the servo motor M7. The rotation of the servo motor M7 is transmitted to the driven gear 94 through the main driving gear 93, whereby the housing 31 rotates about the Z-axis, the wire rod feeding units 30, 30 rotate, and the wire rod is rotated about the Z-axis.

A motor fixing part 2*a* for fixing a servo motor M8 (second rotation unit) is arranged at the lower part of the supporting plate 2. A fit-in hole (not shown) to which the servo motor M8 is fitted is formed in the motor fixing part 2*a*, and the servo motor M8 is fitted and fixed to the fit-in hole. A pulley 38 is coupled to the rotation shaft of the servo motor M8.

A pulley 39 is coupled to the quill 4, and a belt 40 is bridged across the two pulleys 38, 39. The rotation of the servo motor M8 is transmitted to the quill 4 through the pulleys 38, 39 and the belt 40, and the quill 4 rotates about the Z-axis.

Figure 6A:
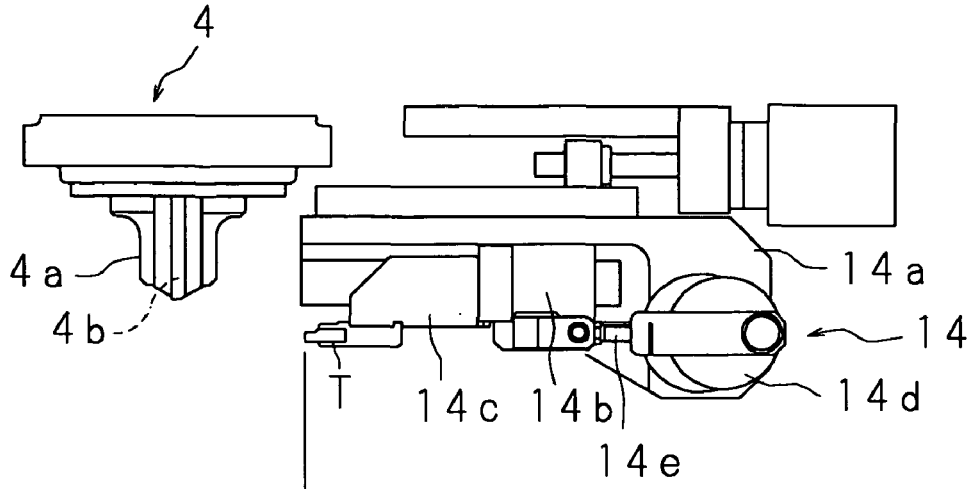
FIGS. 6A, 6B, and 6C are explanatory views for illustrating the movement of a crank slide according to the first embodiment.
Figure 6B:
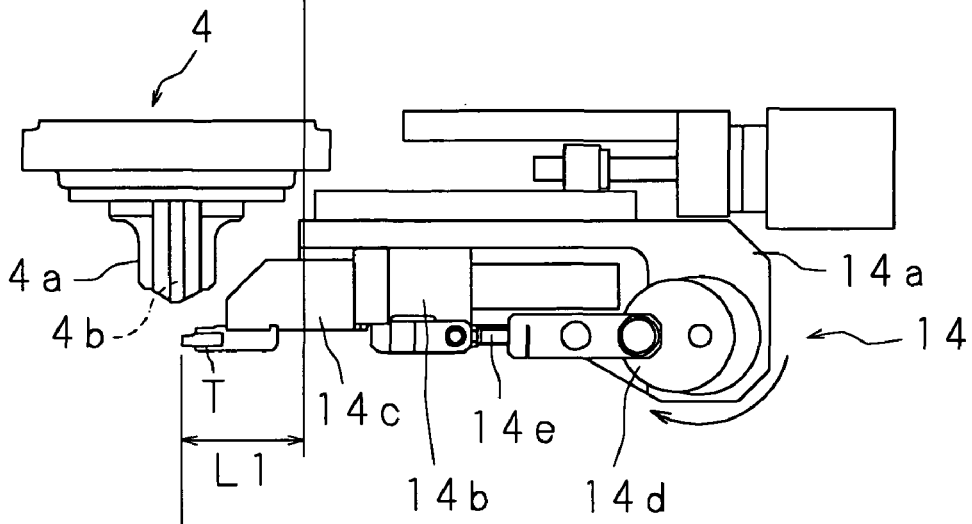
Figure 6C:
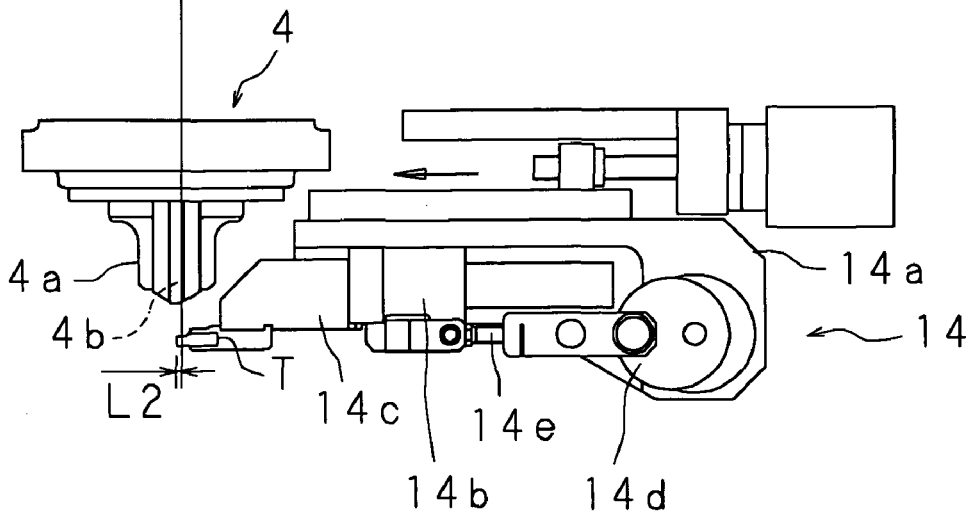

FIGS. 6A to 6C are explanatory views for describing the movement of the crank slide. FIG. 6A is a view showing a state in which a processing tool held by the tool holder of the crank slide is at a position most distant from the wire rod processing space. FIG. 6B is a view showing a state in which the processing tool is moved by the rotation of the crank. FIG. 6C is a view showing a state in which the processing tool is moved by the rotation of the supporting body. L1 of FIG. 6B shows a distance the processing tool moves from the position shown in FIG. 6A to the position shown in FIG. 6B by the rotation of crank. L2 of FIG. 6C shows a distance the processing tool moves from the position shown in FIG. 6B to the position shown in FIG. 6C by the rotation of crank.

In the movement of the processing tool T for processing the wire rod, the slider 14*b* is slide by the rotation of the crank 14*d* to move the processing tool T by the distance L1 and advancing the same to the wire rod processing space 5 (see FIG. 6A, FIG. 6B). The processing tool T is moved by the distance L2 by moving the movable plates W1 to W3 (see FIG. 6C). The processing tool T is advanced to the wire rod processing space 5 at high speed by the crank 14*d*. After advancing, the movable plates W1 to W3 are moved to fine adjust the relative position of the processing tool T and the quill 4.

Figure 7:
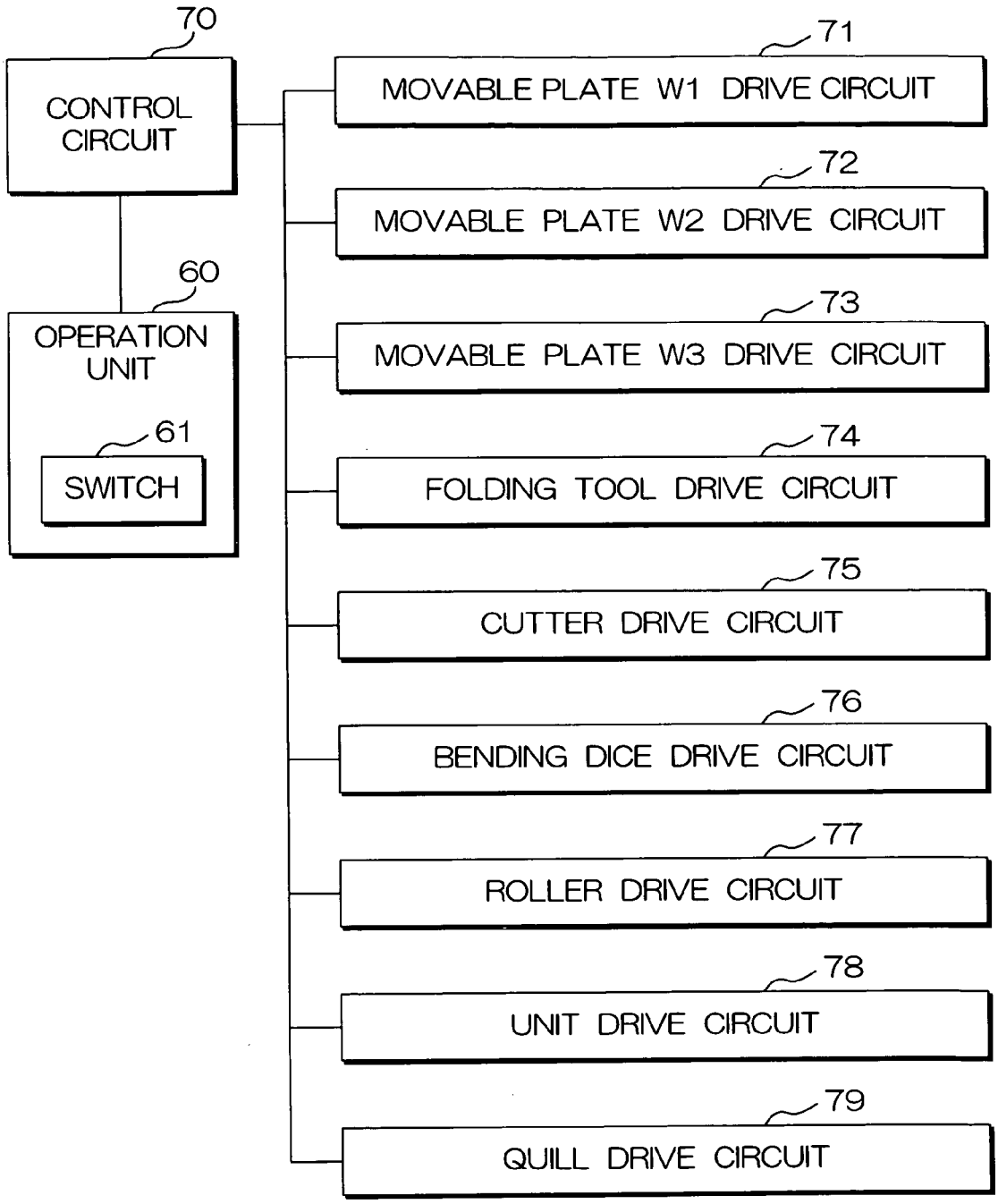
FIG. 7 is a block diagram showing a configuration of a control circuit for controlling the rotation of each servo motor and a drive circuit of each servo motor connected to the control circuit, according to the first embodiment.
Figure 8:
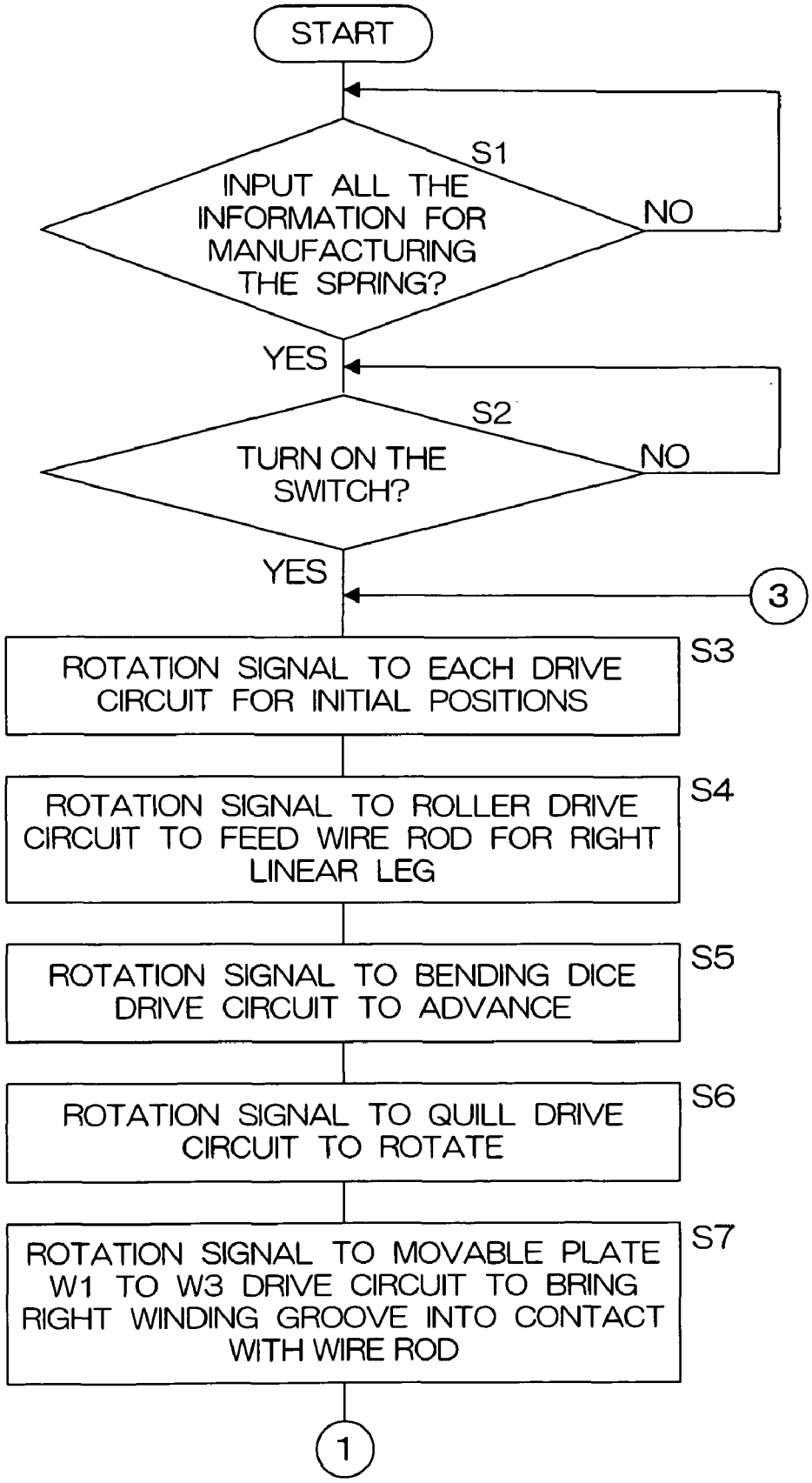
FIG. 8 is a flowchart showing a manufacturing process of a torsion spring according to the first embodiment.
Figure 9:
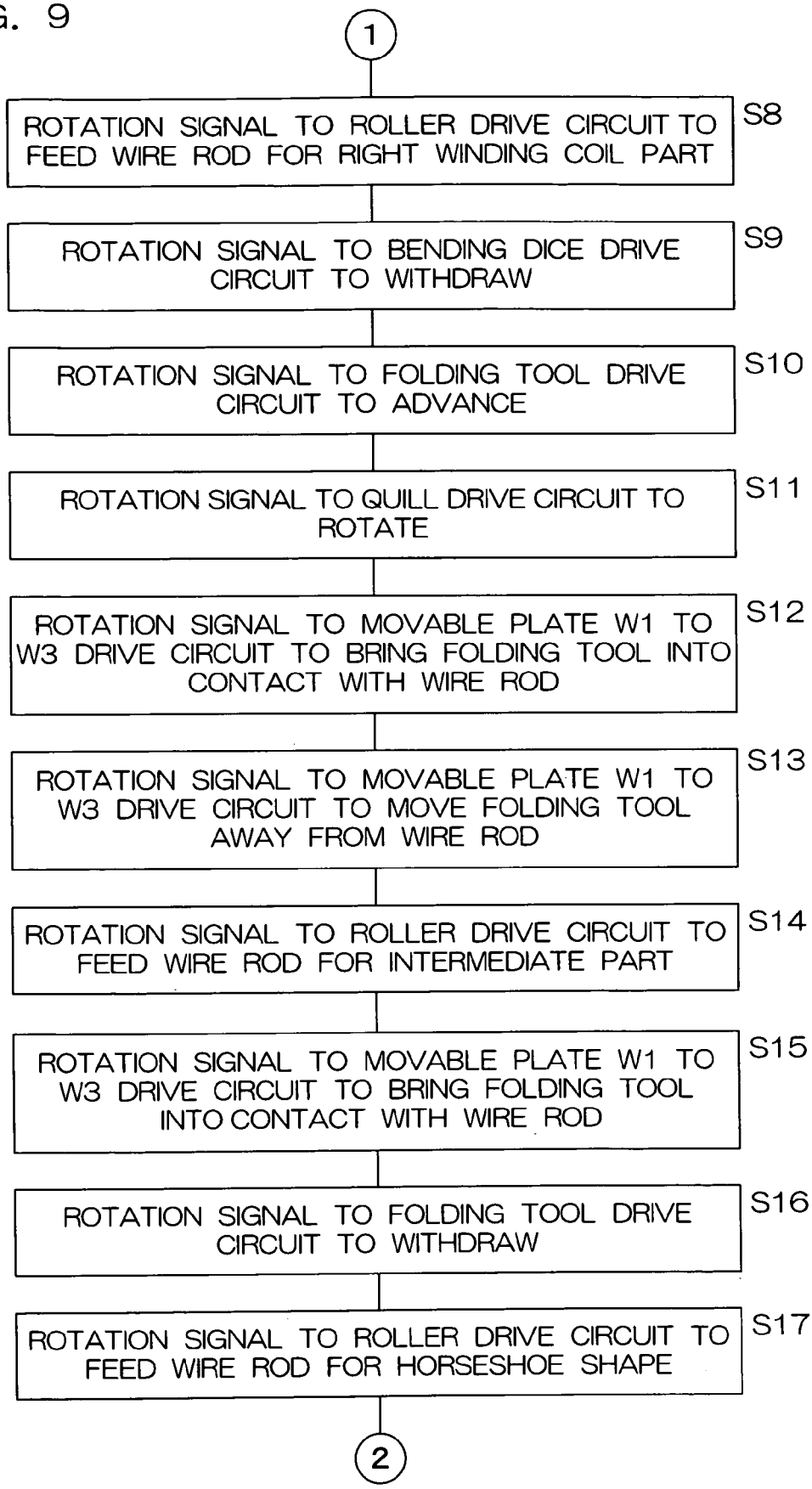
FIG. 9 is a flowchart showing a manufacturing process of the torsion spring according to the first embodiment.
Figure 10:
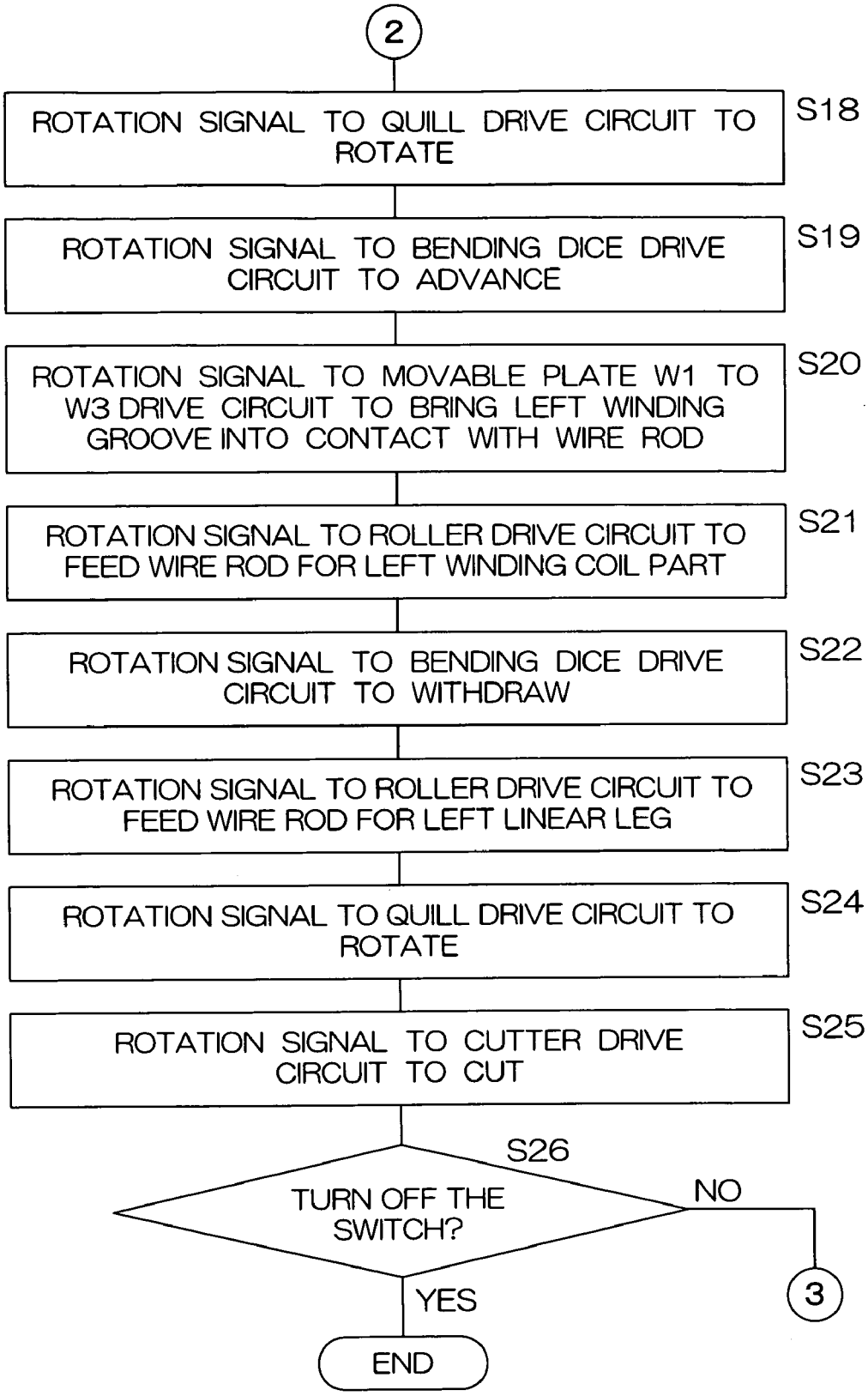
FIG. 10 is a flowchart showing a manufacturing process of the torsion spring according to the first embodiment.

Manufacturing of a torsion spring by the spring manufacturing apparatus will now be described. FIG. 7 is a block diagram showing a configuration of a control circuit for controlling the rotation of each servo motor and a drive circuit of each servo motor connected to the control circuit. FIGS. 8 to 10 are flowcharts showing the manufacturing process of the torsion spring. FIGS. 11A to 22C are explanatory views for describing the movement of the processing tool. FIG. 11A, FIG. 12A, FIG. 13A, FIG. 14A, FIG. 15A, FIG. 16A, FIG. 17A, FIG. 18A, FIG. 19A, FIG. 20A, FIG. 21A and FIG. 22A are schematic front views; FIG. 11B, FIG. 12B, FIG. 13B, FIG. 14B, FIG. 15B, FIG. 16B, FIG. 17B, FIG. 18B, FIG. 19B, FIG. 20B, FIG. 21B, and FIG. 22B are schematic side views; and FIG. 11C, FIG. 12C, FIG. 13C, FIG. 14C, FIG. 15C, FIG. 16C, FIG. 17C, FIG. 18C, FIG. 19C, FIG. 20C, FIG. 21C, and FIG. 22C are schematically bottom views.

The spring manufacturing apparatus includes an operation unit 60, and the operation unit 60 inputs information necessary for manufacturing the spring such as the dimension of the torsion spring to be manufactured including the length of the right leg, the length of the right winding coil part, the length of the intermediate part, the length of the left winding coil part, and the length of the left leg, the type of tools to be used in manufacturing the torsion spring, the attachment position of the tool, and the like. The operation unit 60 includes a switch 61 for inputting start and stop of spring manufacturing. A control circuit 70 (control unit) for controlling the forward-reverse rotation of each servo motor M1 to M8 is connected to the operation unit 60. The control circuit 70 includes a CPU for outputting a rotation signal to a drive circuit to be hereinafter described, a ROM for storing a control program for controlling the forward-reverse rotation of the servo motors M1 to M8, a RAM for temporarily storing information input from the operation unit 60, and the like. The control circuit 70 is connected with a movable plate W1 drive circuit 71 for moving the servo motor M1 coupled to the movable plate W1, a movable plate W2 drive circuit 72 for driving the servo motor M2 coupled to the movable plate W2, a movable plate W3 drive circuit 73 for driving the servo motor M3 coupled to the movable plate W3, a folding tool drive circuit 74 for driving the servo motor M4 of the crank slide 14 holding the folding tool T2, a cutter drive circuit 75 for driving the servo motors M4, M4 of the crank slides 14, 14 holding the cutters T3, T3, a bending dice drive circuit 76 for driving the servo motor M5 of the ball screw slide 15 holding the bending dice T1, a roller drive circuit 77 for driving the servo motor M6 coupled to the wire rod feeding rollers 30, 30, a unit drive circuit 78 for driving the servo motor M7 coupled to the wire rod feeding unit 3, and a quill drive circuit 79 for driving the servo motor M8 coupled to the quill 4. The spring manufacturing apparatus outputs a rotation signal from the control circuit 70 to each drive circuit 71 to 79 to rotate the respective servo motors M1 to M8 for a predetermined number of times.

The control circuit 70 determines whether or not all the information necessary for manufacturing the spring such as the dimension of the torsion spring, the type of tool used in manufacturing the torsion spring, the attachment position of the tool, and the like are input by the operation unit 60 (step S1). If all the information necessary for manufacturing the spring is not input (step S1: NO), the process returns to step S1. If all the information necessary for manufacturing the spring is input (step S1: YES), the control circuit 70 determines whether or not the switch 61 is turned ON (step S2). If the switch 61 is not turned ON (step S2: NO), the process returns to step S2. If the switch 61 is turned ON (step S2: YES), a rotation signal is output from the control circuit 70 to each drive circuit 71 to 76, so that the servo motors M1 to M5 are forward-reverse rotated, and the folding tool T2, the bending dice T1, and the cutters T3, T3 are withdrawn from the wide rod processing space 5 to be arranged at the initial positions set in the control program (step S3).

Figure 11A:
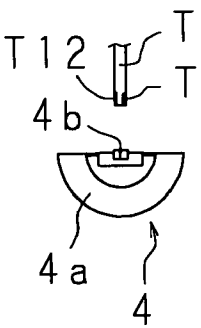
FIGS. 11A, 11B, and 11C are explanatory views for illustrating the movement of a processing tool according to the first embodiment.
Figure 11B:
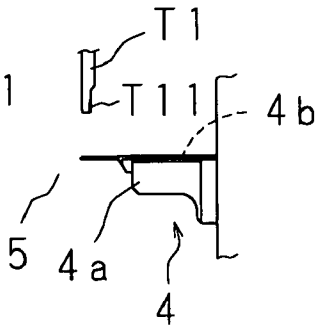
Figure 11C:
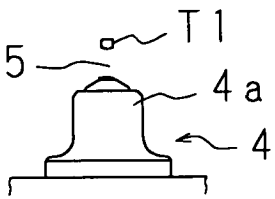
Figure 12A:
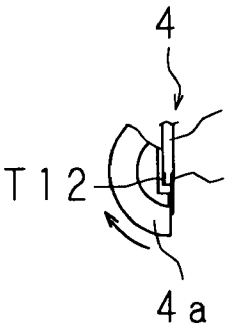
FIGS. 12A, 12B, and 12C are explanatory views for illustrating the movement of the processing tool according to the first embodiment.
Figure 12B:
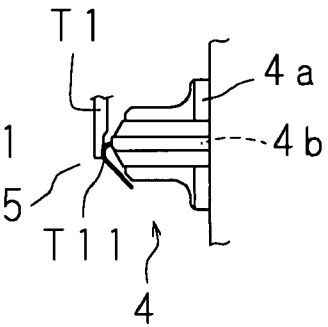
Figure 12C:
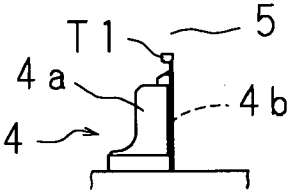

A rotation signal is output from the control circuit 70 to the roller drive circuit 77, so that the servo motor M6 is rotated for a predetermined number of times, the wire rod is fed to the wire rod processing space 5, and the linear right leg is formed (step S4, see FIGS. 11A to 11C). An advancing signal is then output from the control circuit 70 to the bending dice T1 drive circuit, so that the servo motor M5 is forward-rotated over a predetermined number of times and the bending dice T1 is advanced into the wire rod processing space 5 (step S5). A rotation signal is then output from the control circuit 70 to the quill drive circuit 79, so that the quill 4 is rotated to be arranged at a position where it does not contact the right winding coil part to be hereinafter described, as shown with an arrow of FIG. 12A (step S6). Then, a signal indicating to bring the right winding groove T11 into contact with the wire rod is output to the movable plate W1 drive circuit 71, the movable plate W2 drive circuit 72, and the movable plate W3 drive circuit 73, so that the each servo motor M1 to M3 is rotated over a predetermined number of times and the position of the bending dice T1 is fine adjusted, and the right winding groove T11 of the bending dice T1 is brought into contact with the wire rod (step S7, see FIGS. 12A to 12C).

Figure 13A:
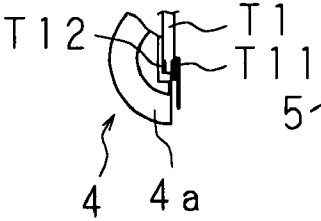
FIGS. 13A, 13B, and 13C are explanatory views for illustrating the movement of the processing tool according to the first embodiment.
Figure 13B:
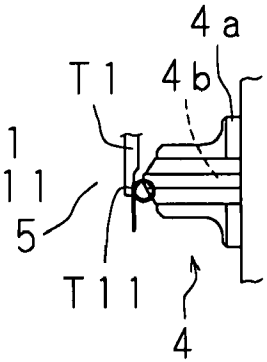
Figure 13C:
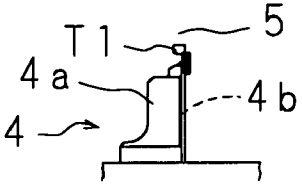
Figure 14A:
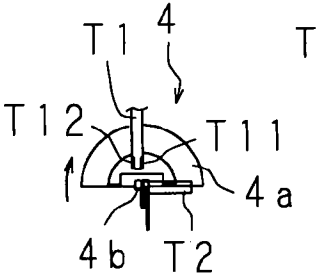
FIGS. 14A, 14B, and 14C are explanatory views for illustrating the movement of the processing tool according to the first embodiment.
Figure 14B:
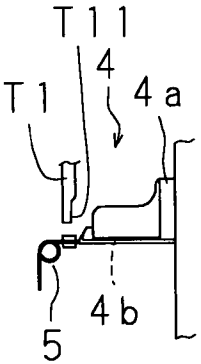
Figure 14C:
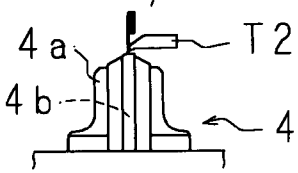
Figure 15A:
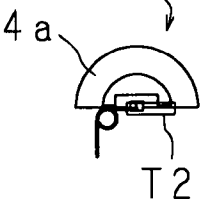
FIGS. 15A, 15B, and 15C are explanatory views for illustrating the movement of the processing tool according to the first embodiment.
Figure 15B:
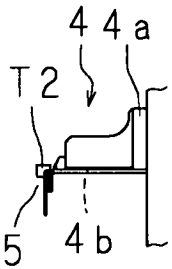
Figure 15C:
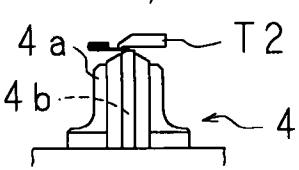
Figure 16A:
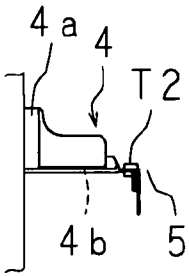
FIGS. 16A, 16B, and 16C are explanatory views for illustrating the movement of the processing tool according to the first embodiment.
Figure 16B:
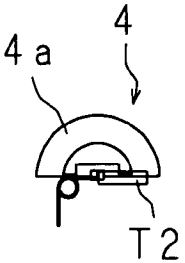
Figure 16C:
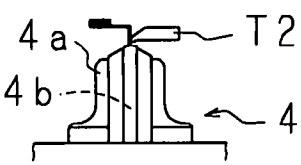
Figure 17A:
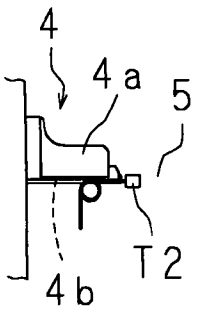
FIGS. 17A, 17B, and 17C are explanatory views for illustrating the movement of the processing tool according to the first embodiment.
Figure 17B:
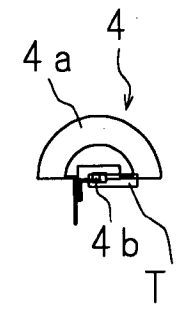
Figure 17C:
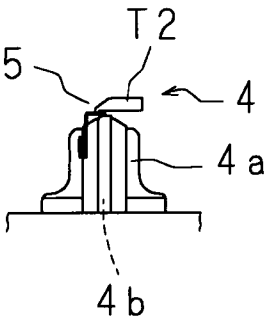
Figure 18A:
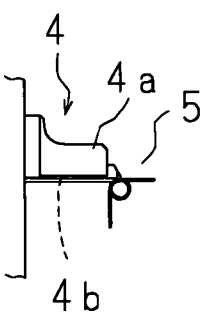
FIGS. 18A, 18B, and 18C are explanatory views for illustrating the movement of the processing tool according to the first embodiment.
Figure 18B:
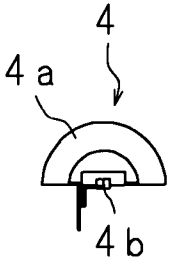
Figure 18C:
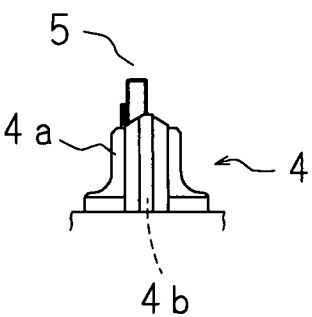
Figure 19A:
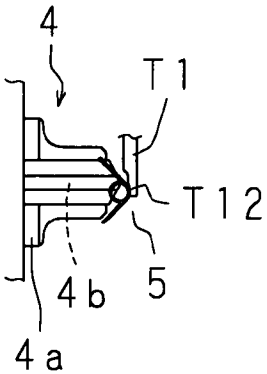
FIGS. 19A, 19B, and 19C are explanatory views for illustrating the movement of the processing tool according to the first embodiment.
Figure 19B:
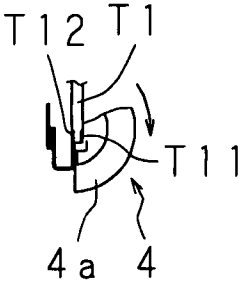
Figure 19C:
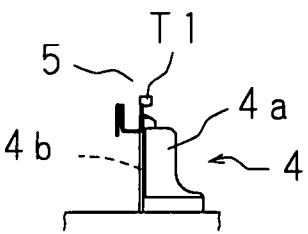
Figure 20A:
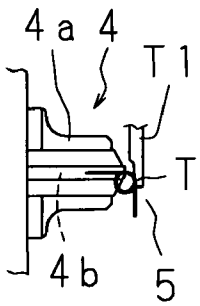
FIGS. 20A, 20B, and 20C are explanatory views for illustrating the movement of the processing tool according to the first embodiment.
Figure 20B:
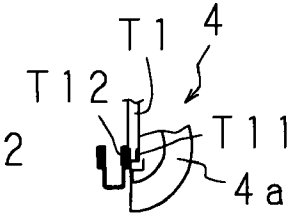
Figure 20C:
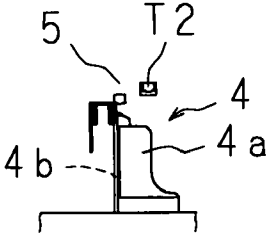
Figure 21A:
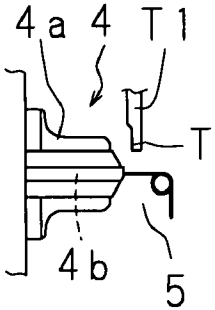
FIGS. 21A, 21B, and 21C are explanatory views for illustrating the movement of the processing tool according to the first embodiment.
Figure 21B:
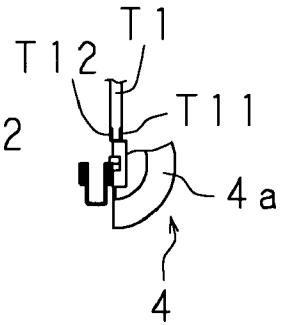
Figure 21C:
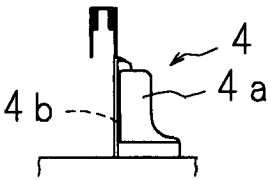
Figure 22A:
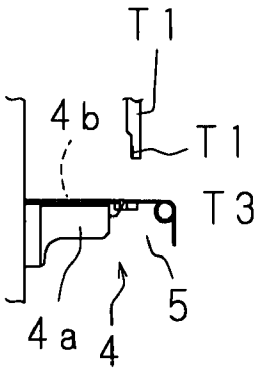
FIGS. 22A, 22B, and 22C are explanatory views for illustrating the movement of the processing tool according to the first embodiment.
Figure 22B:
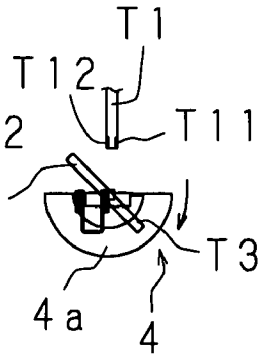
Figure 22C:
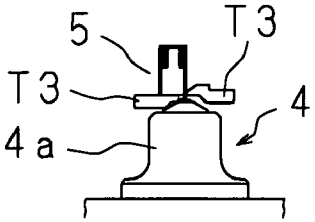

When the wire rod contacts the right winding groove T11, the rotation signal is output from the control circuit 70 to the roller drive circuit 77, so that the servo motor M6 is rotated over a predetermined number of times, the wire rod is fed to the wire rod processing space 5, and the right winding coil part is formed (step S8, see FIGS. 13A to 13C). When the right winding coil part is formed, the withdraw signal is output from the control circuit 70 to the bending dice T1 drive circuit, so that the servo motor M6 is reverse-rotated over a predetermined number of times, and the bending dice T1 is withdrawn from the wire rod processing space 5 (step S9). A rotation signal is then output from the control circuit 70 to the folding tool drive circuit 74, so that the servo motor M4 is rotated over a predetermined number of times, and the folding tool T2 is advanced into the wire rod processing space 5 (step S10). A rotation signal is output to the quill drive circuit 79, so that the quill 4 is rotated and the quill 4 is arranged at a position where the portion of the wire rod processed to a spring does not contact, as shown with an arrow of FIG. 14A (step S11, see FIGS. 14A to 14C). A signal indicating to bring the folding tool T2 into contact with the wire rod is output from the control circuit 70 to the movable plate W1 drive circuit 71, the movable plate W2 drive circuit 72, and the movable plate W3 drive circuit 73, and thus the position of the folding tool T2 is fine adjusted. The folding tool T2 is brought into contact with the wire rod by such fine adjustment, and the wire rod is bent towards the left side towards the front surface (step S12, see FIGS. 15A to 15C).

When the wire rod is bent, a signal indicating to separate the folding tool T2 from the wire rod is output from the control circuit 70 to the movable plate W1 drive circuit 71, the movable plate W2 drive circuit 72, and the movable plate W3 drive circuit 73. According to the output of the signal, the servo motors M1 to M3 are rotated over a predetermined number of times, and the folding tool T2 is separated from the wire rod (step S13). A rotation signal is output from the control circuit 70 to the roller drive circuit 77, so that the servo motor M6 is rotated over a predetermined number times, and the wire rod which forms the intermediate part to be hereinafter described is fed to the wire rod processing space 5 (step S14, see on FIGS. 16A to 16C).

When the wire rod is fed to the wire rod processing space 5, a signal indicating to bring the folding tool T2 into contact with the wire rod is output from the control circuit 70 to the movable plate W1 drive circuit 71, the movable plate W2 drive circuit 72, and the movable plate W3 drive circuit 73. According to the output of the signal, the position of the folding tool T2 is fine adjusted, the folding tool T2 is brought into contact with the wire rod, and the wire rod is bent towards the left side, facing the front surface (step S15, see FIGS. 17A to 17C). When the wire rod is bent, a withdraw signal is output from the control circuit 70 to the folding tool drive circuit 74. According to the output of the signal, the servo motor M4 is rotated over a predetermined number of times and the folding tool T2 is withdrawn from the wire rod processing space 5 (step S16). A rotation signal is then output from the control circuit 70 to the roller drive circuit 77, so that the servo motor M6 is rotated over a predetermined number of times, and the wire rod is fed to the wire rod processing space 5 to form the intermediate part of horseshoe shape (step S17, see FIGS. 18A to 18C).

A rotation signal is then output from the control circuit 70 to the quill drive circuit 79, so that the quill 4 is rotated. As shown with an arrow of FIG. 19B, the quill 4 is rotated and arranged at a position where the portion of the wire rod processed to a spring does not contact while forming the left winding coil part (step S18). An advancing signal is output from the control circuit 70 to the bending dice T1 drive circuit, so that the servo motor M5 is forward-rotated over a predetermined number of times, and the bending dice T1 is advanced into the wire rod processing space 5 (step S19). A signal indicating to bring the left winding groove T12 into contact with the wire rod is output to the movable plate W1 drive circuit 71, the movable plate W2 drive circuit 72, and the movable plate W3 drive circuit 73. According to the output of the signal, each servo motor M1 to M3 is rotated over a predetermined number of times and the position of the bending dice T1 is fine adjusted, and the left winding groove T12 of the bending dice T1 is brought into contact with the wire rod (step S20, see FIGS. 19A to 19C). When the wire rod contacts to the left winding groove T12, a rotation signal is output from the control circuit 70 to the roller drive circuit 77, so that the servo motor M6 is rotated over a predetermined number of times, the wire rod is fed to the wire rod processing space 5, and the left winding coil part is formed (step S21, see FIGS. 20A to 20C).

When the left winding coil part is formed, a withdraw signal is output from the control circuit 70 to the dice drive circuit 76, so that the servo motor M5 is reverse-rotated over a predetermined number of times, and the bending dice T1 is withdrawn from the wire rod processing space 5 (step S22). A rotation signal is then output from the control circuit 70 to the roller drive circuit 77, so that the servo motor M6 is rotated over a predetermined number of times, the wire rod is fed to the wire rod processing space 5, and the linear leg is formed (step S23, see FIGS. 21A to 21C). When the left leg is formed, a rotation signal is output from the control circuit 70 to the quill drive circuit 79. According to such a rotation signal, the quill 4 is rotated and the quill 4 is arranged at a position where the cutters T3, T3 do not contact, as shown with an arrow of FIG. 22B (step S24). A rotation signal is output from the control circuit 70 to the cutter drive circuit 75, so that the servo motor M4 is rotated over a predetermined number of times, and the wire rod is cut by the cutters T3, T3 (step S25, see FIGS. 22A to 22C). Determination is then made on whether or not the switch 61 is turned OFF (step S26). If the switch 61 is turned ON (step S26: NO), the process returns to step S3. If the switch 61 is turned OFF (step S26: YES), the manufacturing of the torsion spring is terminated.

In the spring manufacturing apparatus according to the first embodiment, the openings W1*a*, W2*a*, and W3*a* are opened in the supporting body W including the movable plates W1, W2, and W3 which move in the XYZ orthogonal three-axes directions, the quill 4 is inserted to the openings W1*a*, W2*a*, and W3*a*, and the tool holders 14*c*, 15*c* for holding the processing tool T for processing the wire rod to a spring are arranged on the front surface of the supporting body W, so that the supporting body W arranged at the vicinity of the quill 4 is moved, the relative position of the quill 4 and the processing tool T is accurately adjusted, and a spring of good precision is manufactured. In the spring manufacturing apparatus according to the first embodiment, a desired spring can be manufactured and miniaturization can be achieved while avoiding restrictions on the length of the wire rod that can be fed when manufacturing one spring, the folding or the rotation of the wire rod, and the like. Furthermore, in the spring manufacturing apparatus according to the first embodiment, a number of tool holders 14*c*, 15*c* can be arranged at the vicinity of the quill 4. In the spring manufacturing apparatus according to the first embodiment, the reactive force generated when the processing tool T contacts the wire rod is absorbed by the entire supporting body W, whereby the durability of the supporting body W can be enhanced. In the spring manufacturing apparatus according to the first embodiment, when arranging a plurality of tool holders 14*c*, 15*c* on the supporting body W, and abutting the two processing tools T to process the wire rod, for example, when abutting two cutters T3, T3 to cut the wire rod, the two reactive forces that generate act on opposite directions to each other at the supporting body W and thus are canceled out, whereby the position of the supporting body W can be prevented from being biased.

Moreover, in the spring manufacturing apparatus according to the first embodiment, the crank slides 14, 14, . . . and the ball screw slide 15 that slide the tool holders 14*c*, 15*c* towards and away from the quill 4 and a means for controlling the movement of both slides and the supporting body W are arranged, whereby the advance/withdraw speed of both slides become high compared to the movement speed of the supporting body W, the movements of both slides and the supporting body W can be cooperatively carried out, and the processing tool T held by the tool holders 14*c*, 15*c* can be moved at high speed, and furthermore, the relative position of the quill 4 and the processing tool T can be accurately adjusted in the wire rod processing space 5, and the spring of good precision can be manufactured in a short period of time.

In the spring manufacturing apparatus according to the first embodiment, the servo motors M6, M7, and M8 are respectively coupled to the wire rod feeding roller 30, the housing 31, and the quill 4 by way of the transmission member, whereby the wire rod feeding roller 30, the housing 31, and the quill 4 can be rotated about the axial core of the wire rod. The wire rod can be rotated with the rotation, the processing tool T is avoided from contacting the portion of the wire rod processed to a spring, and the avoided wire rod can be prevented from contacting the quill 4.

The advance/withdraw of the crank slides 14, 14, . . . and the ball screw slide 15, and the movement of the supporting body W can be simultaneously performed, or the ball screw slide 15 can be replaced with the crank slide 14. The quill 4 is stably supported by the supporting plate 2, where the supporting plate 2 prevents the position of the quill 4 from biasing when the processing tool T contacts the wire rod. When forming a plurality of bent portions bent in different directions on the leg, a rotation signal is output to the unit drive circuit 78 to rotate the wire rod, and the folding tool T2 is brought into contact with the wire rod thereby forming the plurality of bent portions.

Second Embodiment

Figure 23:
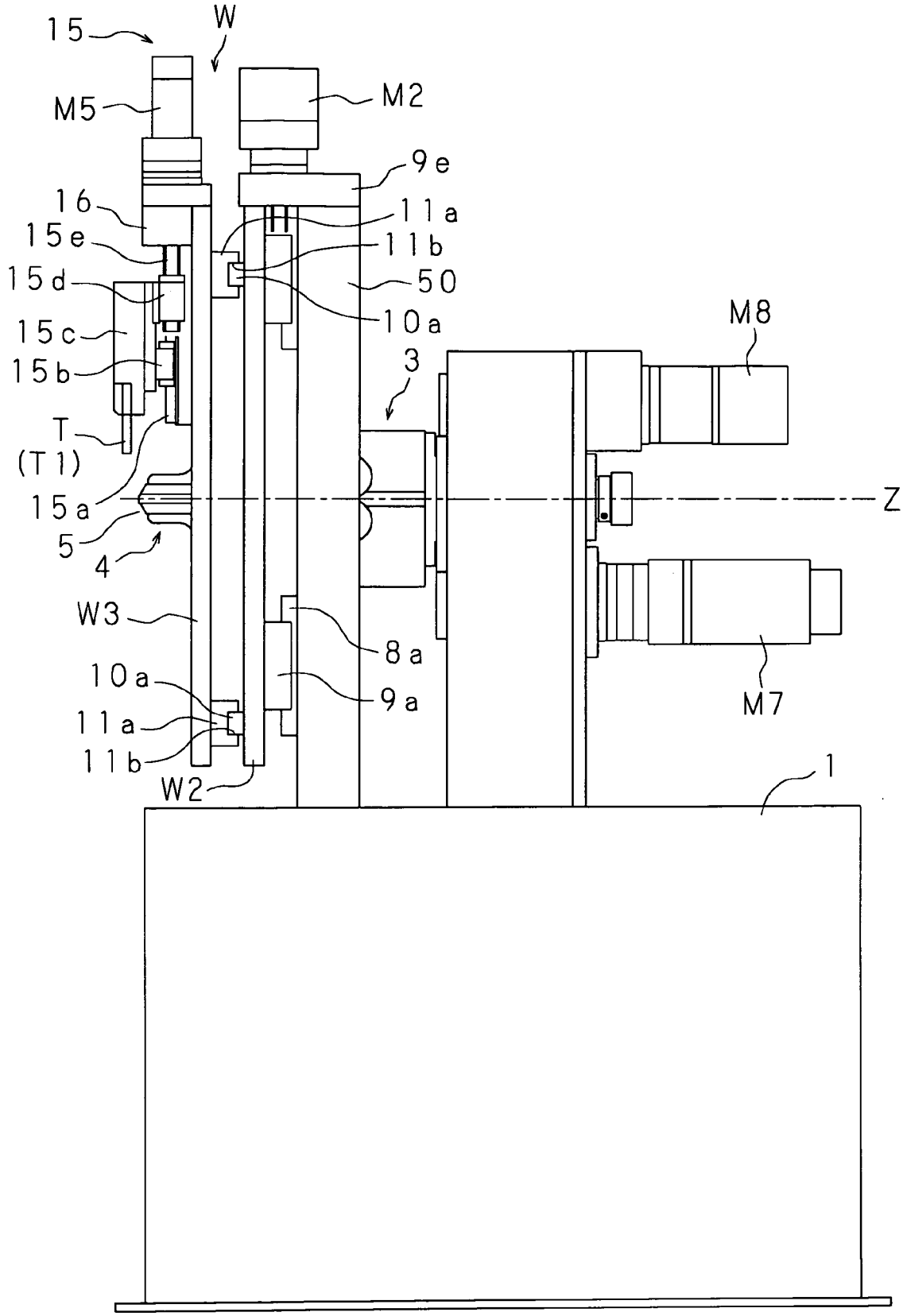
FIG. 23 is a schematic side view of a spring manufacturing apparatus according to a second embodiment.
Figure 24:
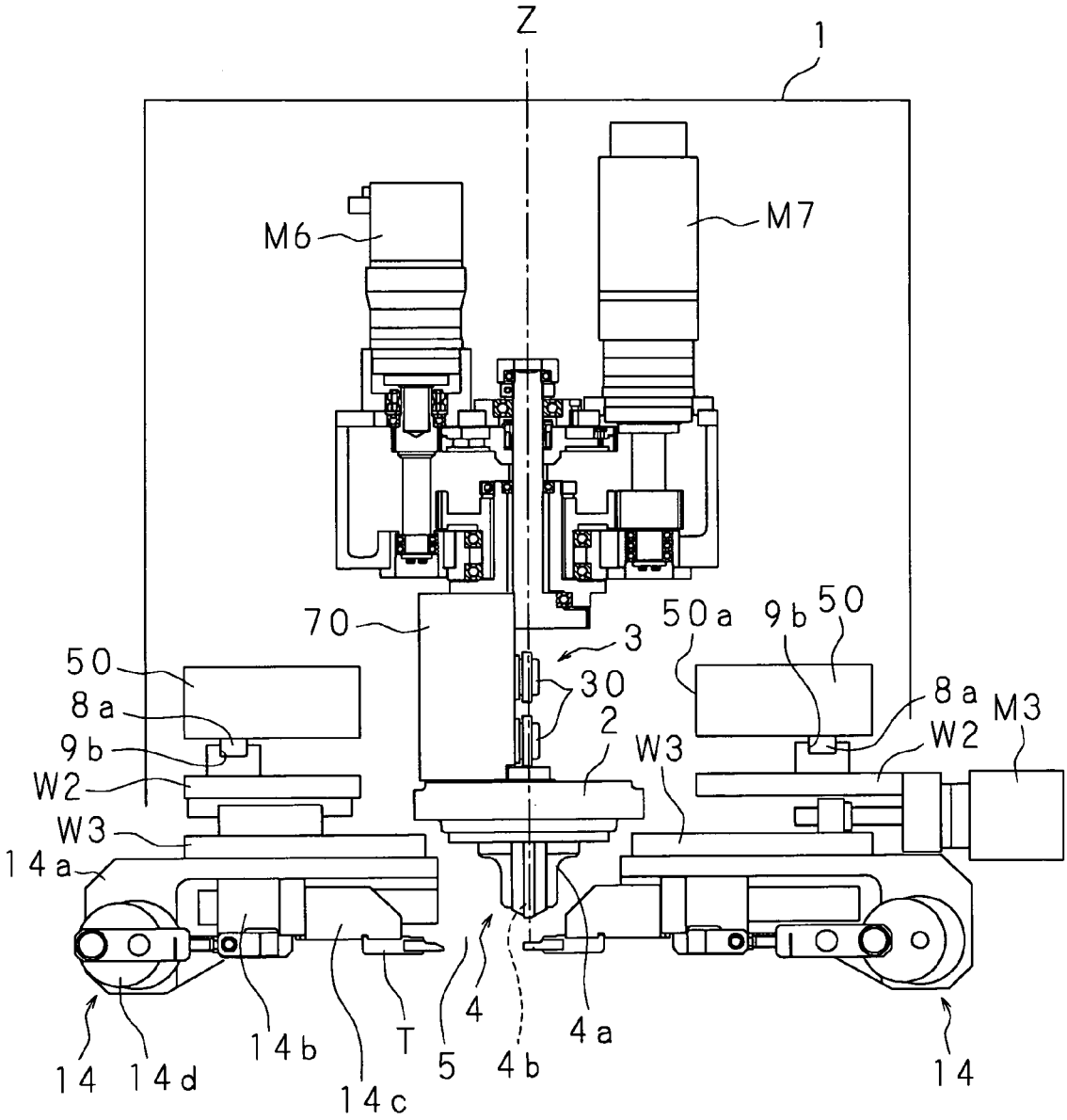
FIG. 24 is a schematic plan partial cross sectional view of the spring manufacturing apparatus according to the second embodiment.

The present invention will now be described in detail with reference to the drawings showing a spring manufacturing apparatus according to a second embodiment. FIG. 23 is a schematic side view of the spring manufacturing apparatus according to the second embodiment. FIG. 24 is a schematic plan partial cross sectional view of the spring manufacturing apparatus.

A supporting body W including two movable plates W2, W3 and an attachment plate 50 attached with the movable plates W2, W3 is arranged at the vicinity of a supporting plate 2 on the upper surface of a base 1. An opening 50*a* cutout in an arch shape is opened in the attachment plate 50 from the lower center portion to the center part of the attachment plate 50. The attachment plate 50 is arranged to surround the wire rod feeding unit 3 with the opening 50*a*. The movable plates W2, W3 are attached in order on the front surface side of the attachment plate 50. As described above, the movable plate W2 and the movable plate W3 are configured to move along the Y-axis and the X-axis, respectively.

Six crank slides 14, 14, . . . and the ball screw slide 15 are radially arranged with the quill 4 as the center on the front surface of the movable plate W3. The folding tool T2 and the cutters T3, T3 held by the crank slides 14, 14, . . . as well as the bending dice T1 held by the ball screw slide 15 are configured to advance and withdraw with respect to the wire rod processing space 5 by sliding the crank slides 14, 14, . . . and the ball screw slide 15 (see FIG. 1). As described above, the servo motors M6, M7, and M8 are respectively coupled to the wire rod feeding roller 30, the housing 31, and the quill 4 (see FIG. 5), so that the wire rod feeding roller 30, the housing 31, and the quill 4 rotate about the Z-axis by the rotation of the servo motors M6, M7, and M8.

The folding tool T2, the cutters T3, T3, and the bending dice T1 are advanced and withdrawn with respect to the wire rod processing space 5 by the crank slides 14, 14, . . . and the ball screw slide 15, and the relative position of the wire rod fed to the wire rod processing space 5 and the folding tool T2 and the bending dice T1 is fine adjusted by the movable plates W2, W3, thereby forming the spring.

In the spring manufacturing apparatus according to the second embodiment, the openings W2*a* and W3*a* are opened in the supporting body W including the movable plates which move in the XY axes directions, the quill 4 is inserted to the openings W2*a* and W3*a*, and the tool holders 14*c*, 15*c* for holding the processing tool T for processing the wire rod to a spring are arranged on the front surface of the supporting body W. Therefore, the supporting body W arranged at the vicinity of the quill 4 is moved to accurately adjust the relative position of the quill 4 and the processing tool T, and thus, a spring of good precision can be manufactured. A desired spring can be manufactured and miniaturization can be achieved while avoiding restrictions on the length of the wire rod that can be fed when manufacturing one spring, the folding or the rotation of the wire rod, and the like. Furthermore, in the spring manufacturing apparatus according to the second embodiment, a great number of tool holders 14*c*, 15*c* can be arranged at the vicinity of the quill 4. In the spring manufacturing apparatus according to the second embodiment, the reactive force generated when the processing tool T contacts the wire rod is absorbed by the entire supporting body W, whereby the durability of the supporting body W can be enhanced. In the spring manufacturing apparatus according to the second embodiment, when arranging a plurality of tool holders 14*c*, 15*c* on the supporting body W, and abutting the two processing tools T to process the wire rod, for example, when abutting two cutters T3, T3 to cut the wire rod, the two reactive forces that generate act on opposite directions to each other at the supporting body W and thus are canceled out, whereby the position of the supporting body W can be prevented from being biased.

Moreover, in the spring manufacturing apparatus according to the second embodiment, the crank slides 14, 14, . . . and the ball screw slide 15 that slide the tool holders 14*c*, 15*c* towards and away from the quill 4 and a means for controlling the movement of both slides and the supporting body W are arranged, whereby the advance/withdraw speed of both slides become high compared to the movement speed of the supporting body W. In the spring manufacturing apparatus according to the second embodiment, the movements of both slides and the supporting body W can be cooperatively carried out. Therefore, the processing tool T held by the tool holders 14*c*, 15*c* can be moved at high speed, and furthermore, the relative position of the quill 4 and the processing tool T can be accurately adjusted in the wire rod processing space 5, and thus, a spring of satisfactory precision can be manufactured in a short period of time.

In the spring manufacturing apparatus according to the second embodiment, the servo motors M6, M7, and M8 are respectively coupled to the wire rod feeding roller 30, the housing 31, and the quill 4 by way of the transmission member, whereby the wire rod feeding roller 30, the housing 31, and the quill 4 can be rotated about the axial core of the wire rod. The wire rod can be rotated with the rotation, so that the portion of wire rod processed to a spring is avoided from contacting the processing tool T, and the avoided wire rod is prevented from contacting the quill 4.

The configurations of the spring manufacturing apparatus according to the second embodiment similar to the configurations of the first embodiment are denoted with the same reference numerals, and the detailed description thereof will be omitted.

Third Embodiment

Figure 25:
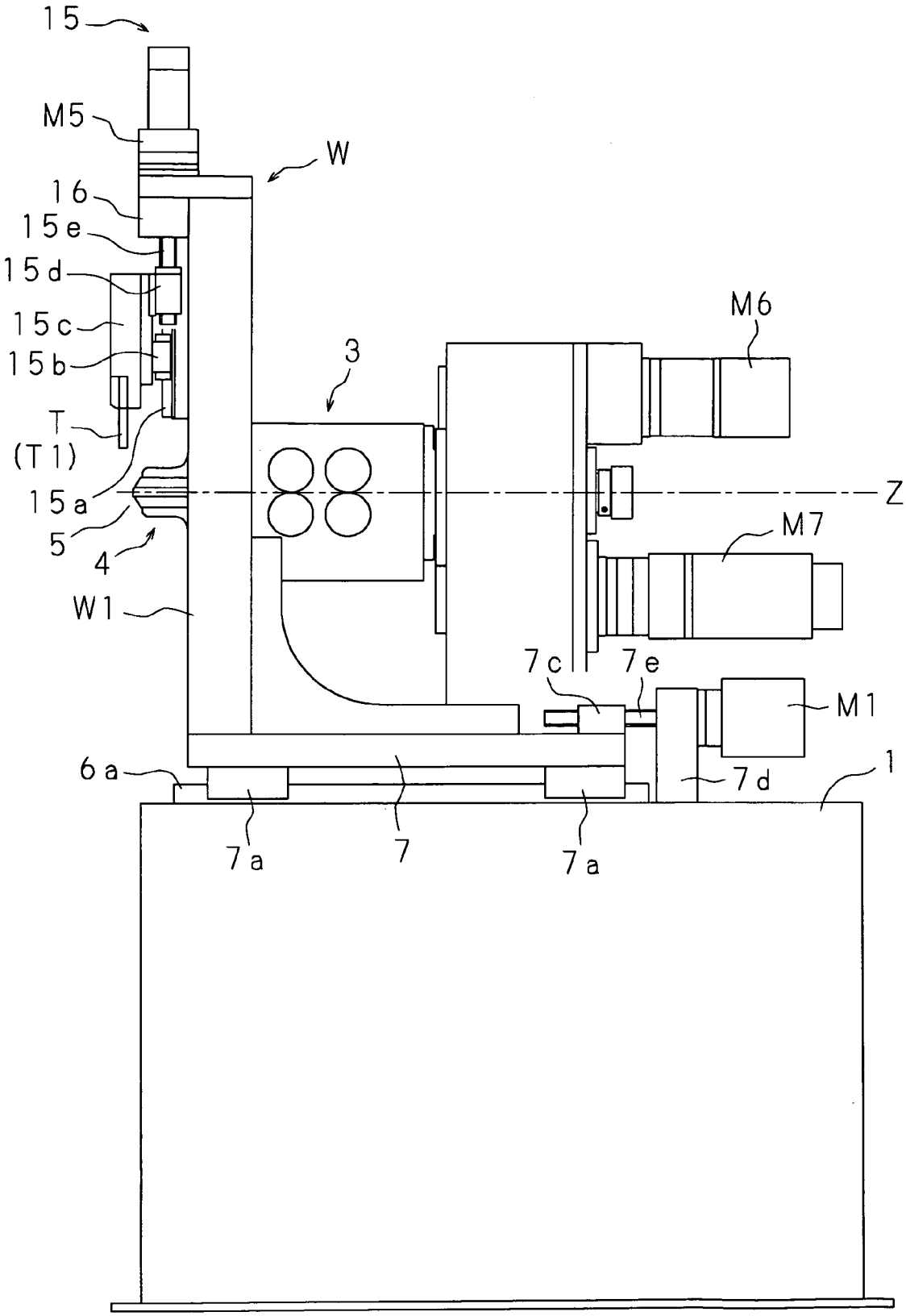
FIG. 25 is a schematic side view of a spring manufacturing apparatus according to a third embodiment.
Figure 26:
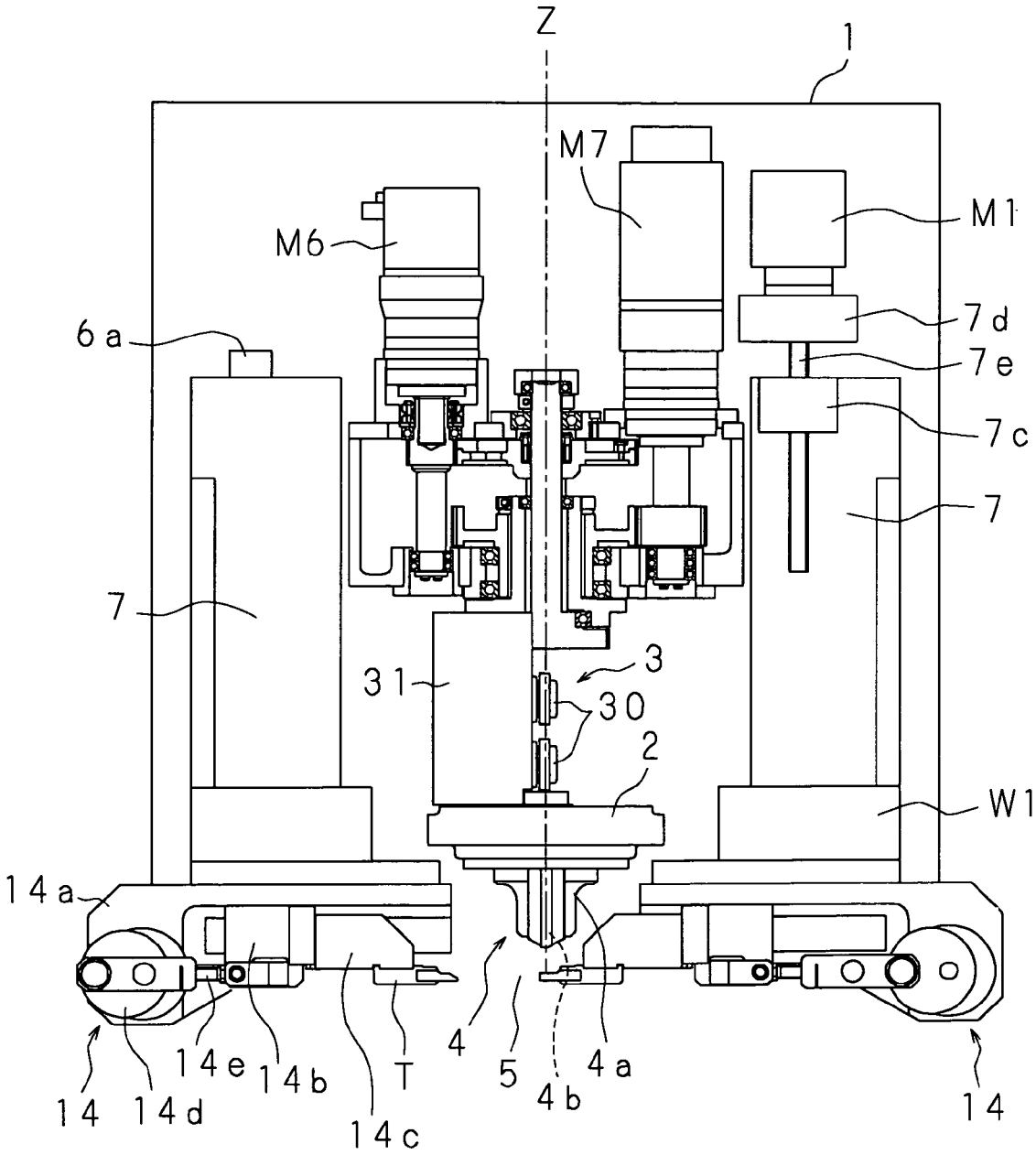
FIG. 26 is a schematic plan partial cross sectional view of the spring manufacturing apparatus according to the third embodiment.

The present invention will now be described in detail with reference to the drawings showing a spring manufacturing apparatus according to a third embodiment. FIG. 25 is a schematic side view of the spring manufacturing apparatus according to the third embodiment. FIG. 26 is a schematic plan partial cross sectional view of the spring manufacturing apparatus.

A supporting body W including the movable plate W1 is arranged on the upper surface of a base 1. An opening W1*a* cutout in an arch shape is opened in the movable plate W1 from the lower center portion to the center part of the movable plate W1. The movable plate W1 is arranged to surround a quill 4 with the opening W1*a*. As described above, the movable plate W1 is configured to move along the Z-axis.

Six crank slides 14, 14, . . . and a ball screw slide 15 are radially arranged with the quill 4 as the center on the front surface of the movable plate W1. A folding tool T2 and cutters T3, T3 held by the crank slides 14, 14, . . . as well as the bending dice T1 held by the ball screw slide 15 are configured to advance and withdraw with respect to the wire rod processing space 5 by sliding the crank slides 14, 14, . . . and the ball screw slide 15 (see FIG. 1). As described above, servo motors M6, M7, and M8 are respectively coupled to a wire rod feeding roller 30, a housing 31, and the quill 4 (see FIG. 5). The wire rod feeding roller 30, the housing 31, and the quill 4 thus rotate about the Z-axis by the rotation of the servo motors M6, M7, and M8.

The folding tool T2, the cutters T3, T3, and the bending dice T1 are advanced and withdrawn with respect to the wire rod processing space 5 by the crank slides 14, 14, . . . and the ball screw slide 15, and the relative position of the wire rod fed to the wire rod processing space 5 as well as the folding tool T2 and the bending dice T1 is fine adjusted by the movable plate W1, thereby forming a spring.

In the spring manufacturing apparatus according to the third embodiment, the opening W1*a* is opened in the supporting body W including the movable plates which moves in the Z-axis direction, the quill 4 is inserted to the opening W1*a*, and the tool holders 14*c*, 15*c* for holding the processing tool T for processing the wire rod to a spring are arranged on the front surface of the supporting body W, so that the supporting body W arranged at the vicinity of the quill 4 is moved to accurately adjust the relative position of the quill 4 and the processing tool T, a spring of good precision can be manufactured, and miniaturization can be achieved. Furthermore, in the spring manufacturing apparatus according to the third embodiment, a number of tool holders 14*c*, 15*c* can be arranged at the vicinity of the quill 4. In the spring manufacturing apparatus according to the third embodiment, the reactive force generated when the processing tool T contacts the wire rod is absorbed by the entire supporting body W, whereby the durability of the supporting body W can be enhanced. In the spring manufacturing apparatus according to the third embodiment, when arranging a plurality of tool holders 14*c*, 15*c* on the supporting body W, and abutting the two processing tools T to process the wire rod, for example, when abutting two cutters T3, T3 to cut the wire rod, the two reactive forces that generate act on opposite directions to each other at the supporting body W and thus are canceled out, whereby the position of the supporting body W can be prevented from being biased.

Moreover, in the spring manufacturing apparatus according to the third embodiment, the crank slides 14, 14, . . . and the ball screw slide 15 that slide the tool holders 14*c*, 15*c* towards and away from the quill 4 and a means for controlling the movement of both slides and the supporting body W are arranged, whereby the advance/withdraw speed of both slides become high compared to the movement speed of the supporting body W. In the spring manufacturing apparatus according to the third embodiment, the movements of both slides and the supporting body W can be cooperatively carried out. Therefore, the processing tool T held by the tool holders 14*c*, 15*c* can be moved at high speed, and furthermore, the relative position of the quill 4 and the processing tool T can be accurately adjusted in the wire rod processing space 5, and thus, a spring of good precision can be manufactured in a short period of time. In the spring manufacturing apparatus according to the third embodiment, a desired spring can be manufactured and miniaturization of the spring manufacturing apparatus can be achieved while avoiding restrictions on the length of the wire rod that can be fed when manufacturing one spring, the folding or the rotation of the wire rod, and the like.

In the spring manufacturing apparatus according to the third embodiment, the servo motors M6, M7, and M8 are respectively coupled to the wire rod feeding roller 30, the housing 31, and the quill 4 by way of the transmission member, whereby the wire rod feeding roller 30, the housing 31, and the quill 4 can be rotated about the axial core of the wire rod. The wire rod can be rotated with the rotation, the processing tool T is avoided from contacting the portion of the wire rod processed to a spring, and the avoided wire rod can be prevented from contacting the quill 4.

The configurations of the spring manufacturing apparatus according to the third embodiment similar to the configurations of the first and second embodiments are denoted with the same reference numerals, and the detailed description thereof will be omitted.

Fourth Embodiment

Figure 27:
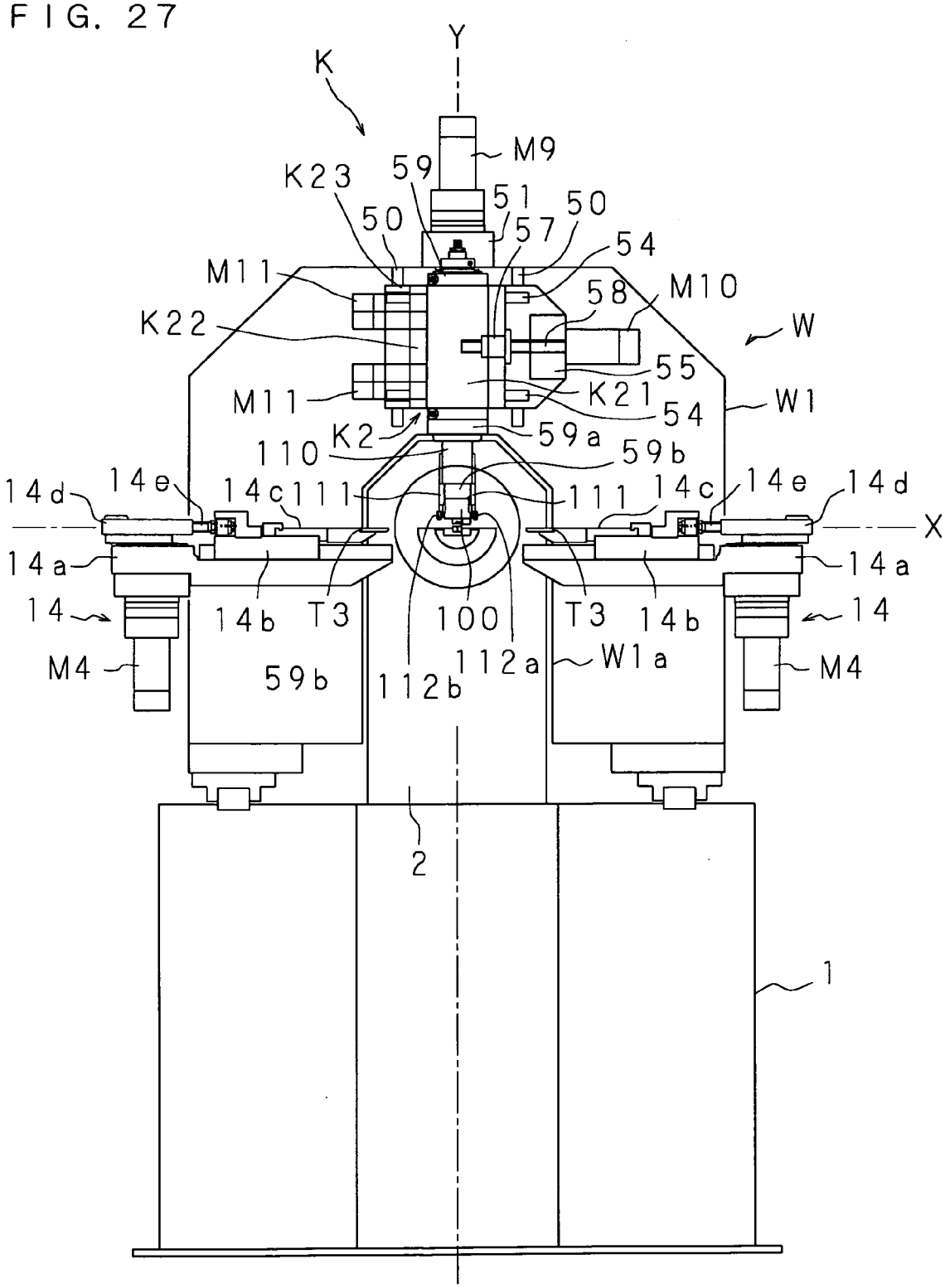
FIG. 27 is a schematic front view of a spring manufacturing apparatus according to a fourth embodiment.
Figure 28:
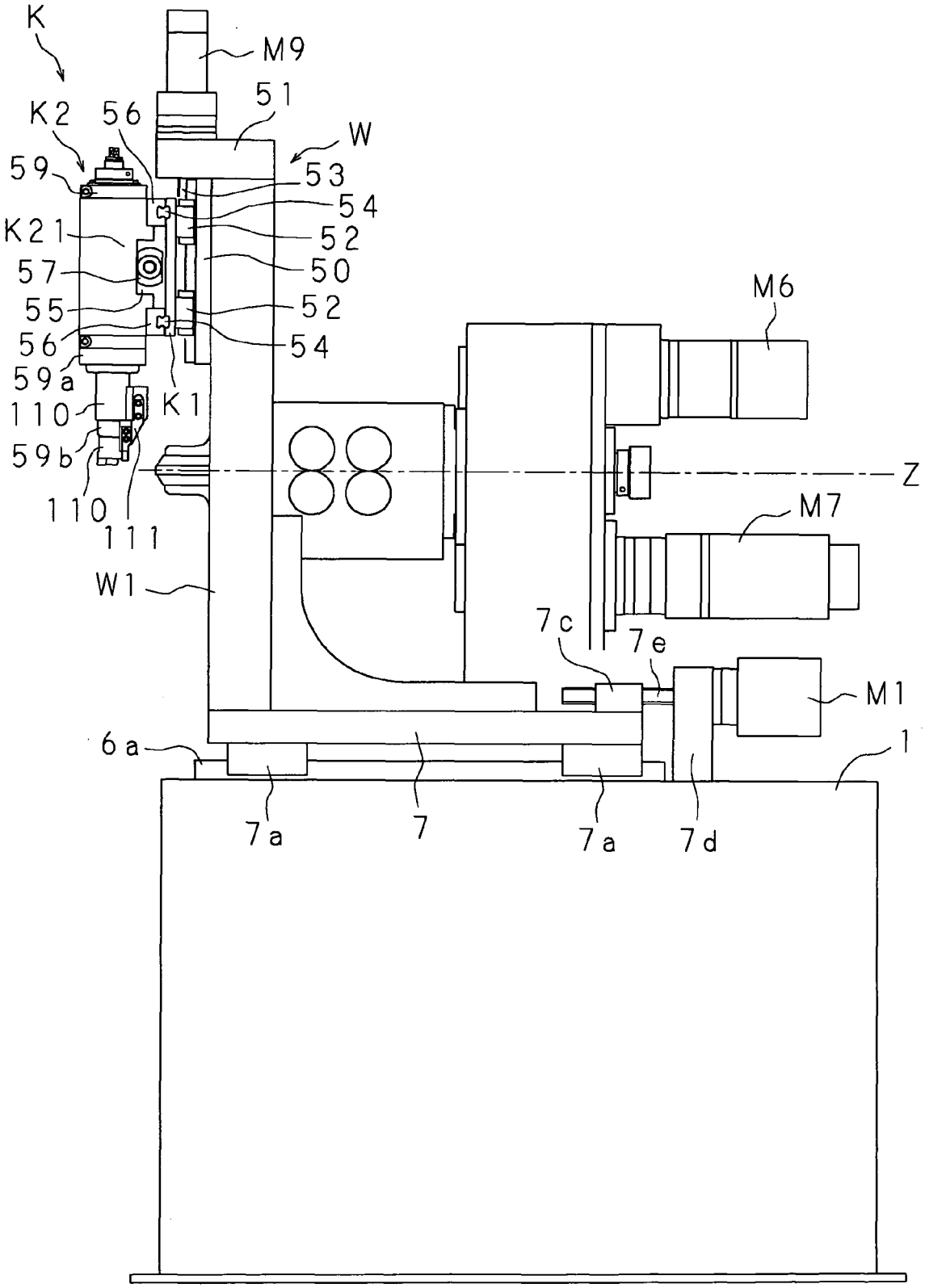
FIG. 28 is a schematic side view of the spring manufacturing apparatus according to the fourth embodiment.

The present invention will now be described in detail with reference to the drawings showing a spring manufacturing apparatus according to a fourth embodiment. FIG. 27 is a schematic front view of the spring manufacturing apparatus according to the fourth embodiment. FIG. 28 is a schematic side view of the spring manufacturing apparatus.

A supporting body W including a movable plate W1 is arranged on the upper surface of a base 1. An opening W1*a* cutout in an arch shape is opened in the movable plate W1 from the lower center portion to the center part of the movable plate W1. The movable plate W1 is arranged to surround the quill 4 with the opening W1*a*. As described above, the movable plate W1 is configured to move along the Z-axis. That is, in the fourth embodiment, a servo motor M1 acts as a supporting body driving source. A movable unit K including a table K1 and an operation device accommodating body K2 to be hereinafter described is provided on the upper part of the movable plate W1.

Two crank slides 14, 14 are respectively arranged on the X-axis on the left and the right sides of the quill 4 at the front surface of the movable plate W1. Two cutters T3, T3 are respectively held by the two crank slides 14, 14. That is, two cutting parts for cutting the wire rod are arranged to be point symmetric about the quill as the center. As described above, the two cutters T3, T3 are advanced and withdrawn with respect to the wire rod processing space 5 by sliding the crank slides 14, 14. The servo motors M6, M7, and M8 are respectively connected to the wire rod feeding roller 30, the housing 31, and the quill 4, as described above (see FIG. 5), so that the wire rod feeding roller 30, the housing 31, and the quill 4 are rotated about the Z-axis by the rotation of the servo motors M6, M7, and M8.

Two rails 50, 50 are arranged side by side along the Y-axis above the quill 4 at the front surface of the movable plate W1. A block shaped motor fixing part 51 for fixing a servo motor M9 (second movable unit driving source) is arranged at the upper part of the front surface of the movable plate W1. A fit-in hole to which the servo motor M9 is fitted is formed in the motor fixing part 51, passing in the up and down direction.

The table K1 of the movable unit K is arranged on the front surface side of the rails 50, 50. Four sliding members 52, 52, . . . that slide on the rails 50, 50 are arranged at the four corners of the rear surface of the table K1. The sliding members 52, 52, . . . have a substantially rectangular solid shape, wherein a groove is formed on a surface facing the rails 50, 50 so that the rails 50, 50 are fitted to slide. A nut part (not shown) to which a male screw 53 to be hereinafter described is screwed in is formed at the center on the upper part of the rear surface of the table K1.

The servo motor M9 capable of forward-reverse rotating is fitted and fixed to the fit-in hole of the motor fixing part 51, and a male screw 53 is continued to the rotation shaft of the servo motor M9. The male screw 53 is screwed into the nut part. A ball (not shown) is fitted in a rolling manner in a groove portion of the male screw 53 and the nut part, thereby configuring a ball screw mechanism.

The forward-reverse rotation of the servo motor M9 is converted to a translatory movement by the male screw 53 and the nut part. When the servo motor M9 forward rotates, the sliding members 52, 52, . . . slide on the rails 50, 50, and the table K1 moves towards the lower side along the Y axis. When the servo motor M9 reverse rotates, the table K1 moves towards the upper side along the Y axis.

Two rails 54, 54 are respectively fixed along both upper and lower sides of the table K1 at the front surface of the table K1. A block shaped fixing part 55 for fixing a servo motor M10 to be hereinafter described is arranged at the center on the right side of the front surface. A fit-in hole to be fitted with the servo motor 10 (first movable unit driving source) is opened at the center in the motor fixing part 55, passing in the left and right direction.

A operation device accommodating body K2 of the movable unit K is arranged on the front surface side of the rails 54, 54. The operation device accommodating body K2 includes a block shaped accommodating body K21 for accommodating a spindle operation device 59 to be hereinafter described. The accommodating unit 21 includes a cylindrical accommodating chamber formed by penetrating an axial center portion. The operation device accommodating body K2 includes two elongate collar parts K22, K22 continued along both sides in the longitudinal direction of one surface of the accommodating unit K21, and is arranged with one surface facing the front surface side of the rails 54, 54.

Four sliding members 56, 56, . . . that slide on the rails 54, 54 are arranged at both ends of the collar parts K22, K22 at positions facing the rails 54, 54. The sliding members 56, 56, . . . have a substantially rectangular solid shape, wherein a groove is formed on a face facing the rails 54, 54 so that the rails 54, 54 are fitted in the groove to slide. A nut part 57 to which a male screw 58 to be hereinafter described is screwed in is formed at the collar part 22 on the motor fixing part 55 side.

The servo motor M10 capable of forward-reverse rotation is fitted and fixed to the fit-in hole of the motor fixing part 55, and the male screw 58 is continued to the rotation shaft of the servo motor M10. The male screw 58 is screwed into the nut part 57. A ball (not shown) is fitted in a rolling manner in a groove portion of the male screw 58 and the nut part 57, thereby configuring a ball screw mechanism.

The forward-reverse rotation of the servo motor M10 is converted to a translatory movement by the male screw 58 and the nut part 57. When the servo motor M10 forward-rotates, the sliding members 56, 56, . . . slide on the rails 54, 54, and the operation device accommodating body K2 moves towards the right side, facing the front surface along the X axis. When the servo motor M10 is reverse-rotated, the operation device accommodating body K2 moves towards the left side, facing the front surface along the X axis.

The circular column shaped spindle operation device 59 is accommodated in the accommodating chamber of the accommodating unit 21. The spindle operation device 59 includes an operation device body 59*a*, and a spindle attachment part 59*b* (tool holder) arranged at the lower end of the operation device body 59*a*. The spindle attachment part 59*b* extends from the accommodating unit 21, and a spindle 100 is attached to the spindle attachment part 59*b*. Two servo motors M1, M1 are connected at the side surface of the spindle operation device 59.

Figure 29:
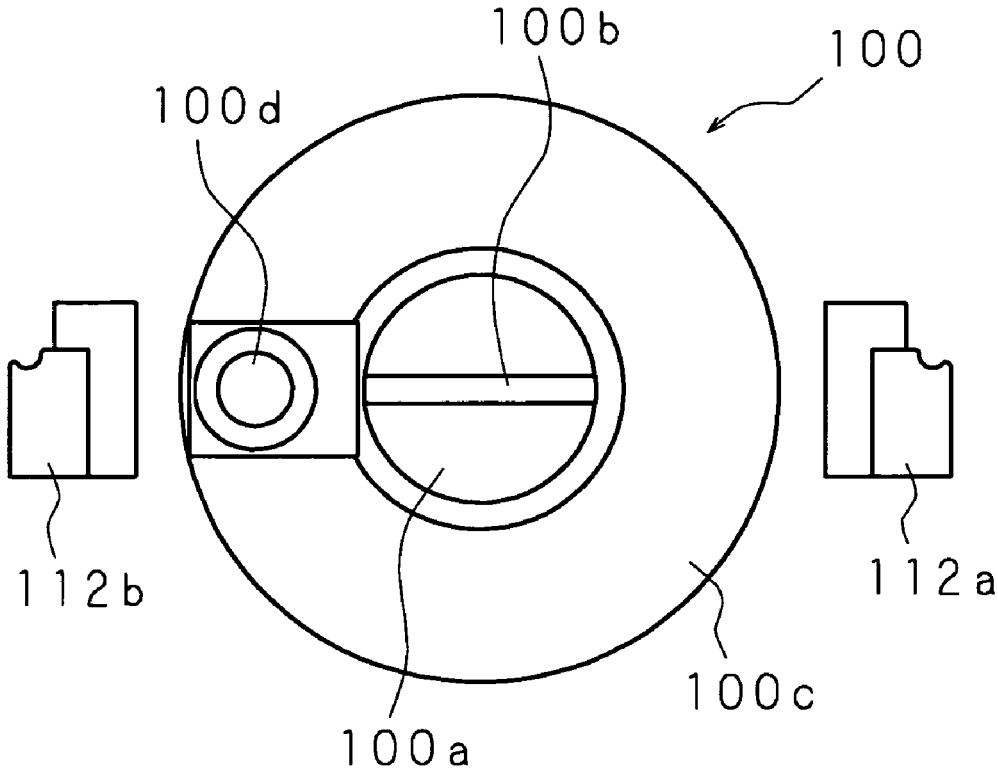
FIG. 29 is a frame format bottom view showing a spindle, a right wind bending dice, and a left wind bending dice to be attached to the spring manufacturing apparatus according to the fourth embodiment.

FIG. 29 is a frame format bottom view showing a spindle, a right wind bending dice, and a left wind bending dice to be attached to the spring manufacturing apparatus. The spindle 100 includes an inner circular column 100*a*, and an outer sleeve 100*c* arranged at the vicinity of the inner circular column 100*a*. A linear groove 100*b* is formed at the end face of the inner circular column 100*a* to engage the wire rod, and a projection 100*d* is formed at the end of the outer sleeve 100*c* to bend the wire rod. The two servo motors M11, M11 are coupled to the inner circular column 100*a* and the outer sleeve 100*c*, respectively. When the servo motor M1 forward rotates, the outer sleeve 100*c* rotates in the counterclockwise direction, and when the servo motor M11 reverse rotates, the outer sleeve 100*c* rotates in the clockwise direction. The inner circular column 100*a* also rotates by the rotation of the servo motor M11.

A supporting cylinder 100 for supporting a bending dice attachment jig 111 (tool holder) is arranged at the periphery of the spindle attachment part 59*b*, and the supporting cylinder 110 is fixed to the operation device body 59*a*. Two bending dice attachment jigs 111, 111 are supported at the left and right sides of the supporting cylinder 110. The bending dice attachment jig 111 on the right side is attached with a right wind bending dice 112*a*, and the bending dice attachment jig 111 on the left side is attached with a left wind bending dice 112*b*.

When the spindle 100 is attached to the spindle attachment part 59*b*, and the right wind bending dice 112*a* and the left wind bending dice 112*b* are respectively attached to the two bending dice attachment jigs 111, 111, the spindle 100, the right wind bending dice 112*a*, and the left wind bending dice 112*b* are arranged along the X-axis direction.

Figure 30:
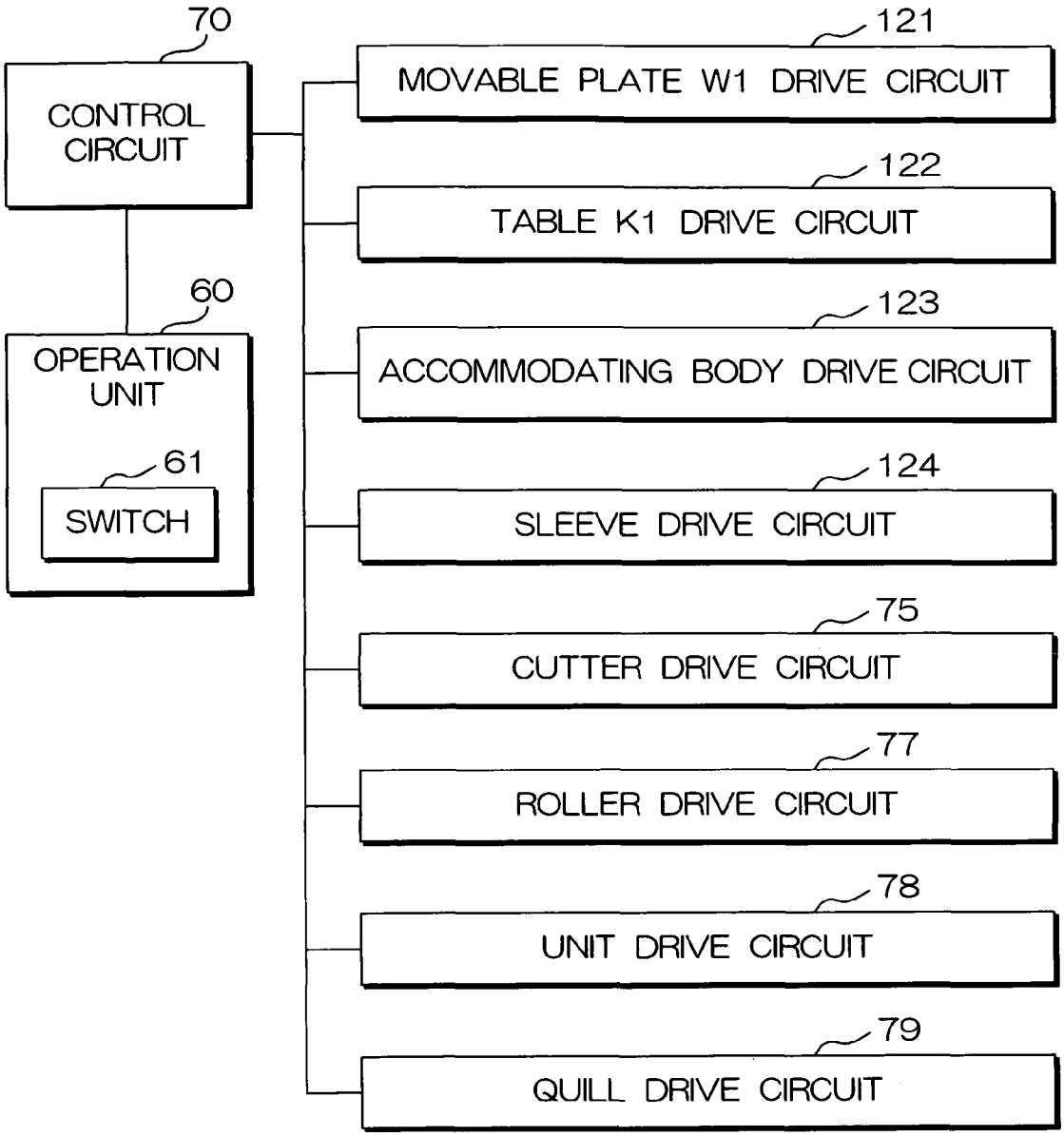
FIG. 30 is a block diagram showing a configuration of a control circuit for controlling the rotation of each servo motor and a drive circuit of each servo motor connected to the control circuit, according to the fourth embodiment.
Figure 31:
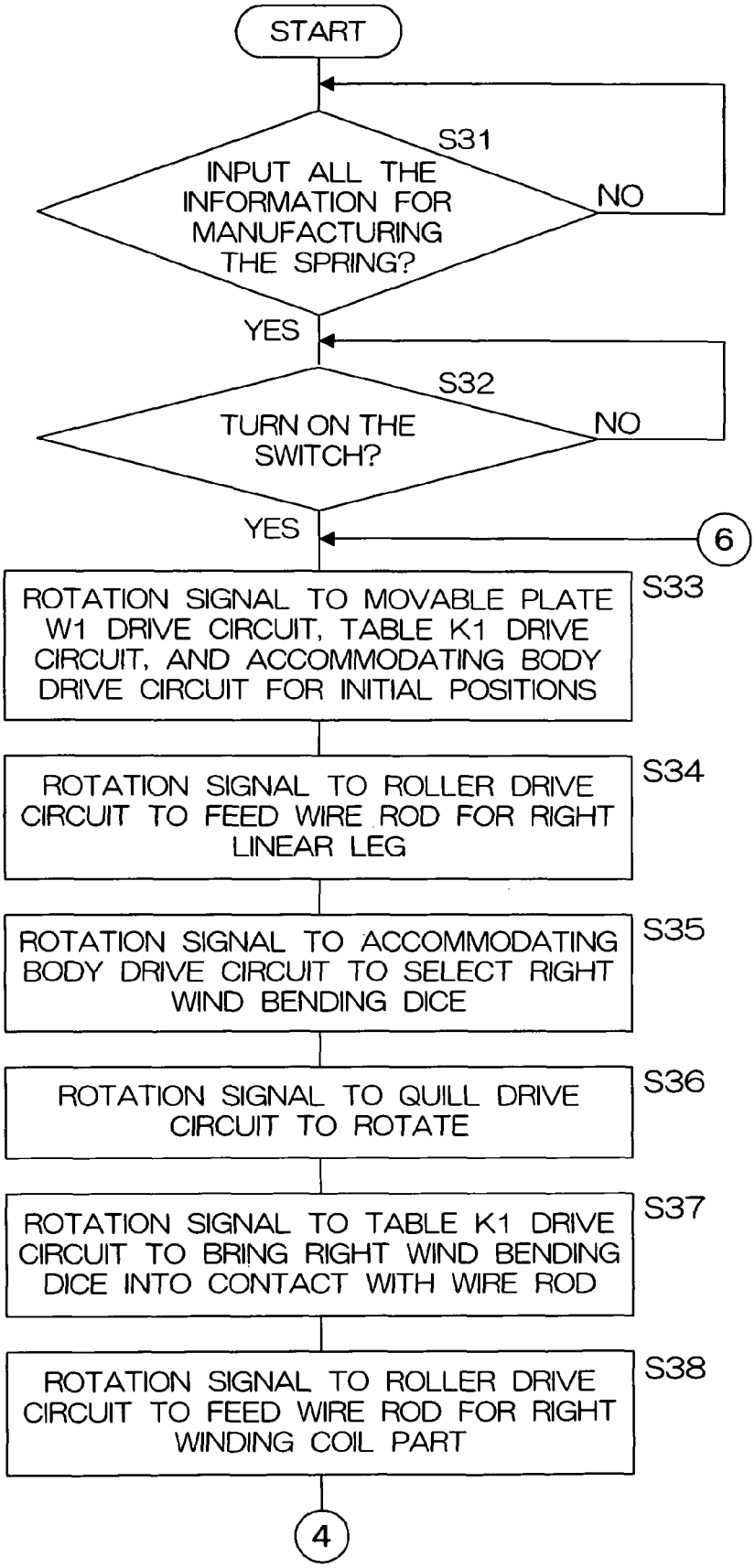
FIG. 31 is a flowchart showing a manufacturing process of a torsion spring by the spring manufacturing apparatus according to the fourth embodiment.
Figure 32:
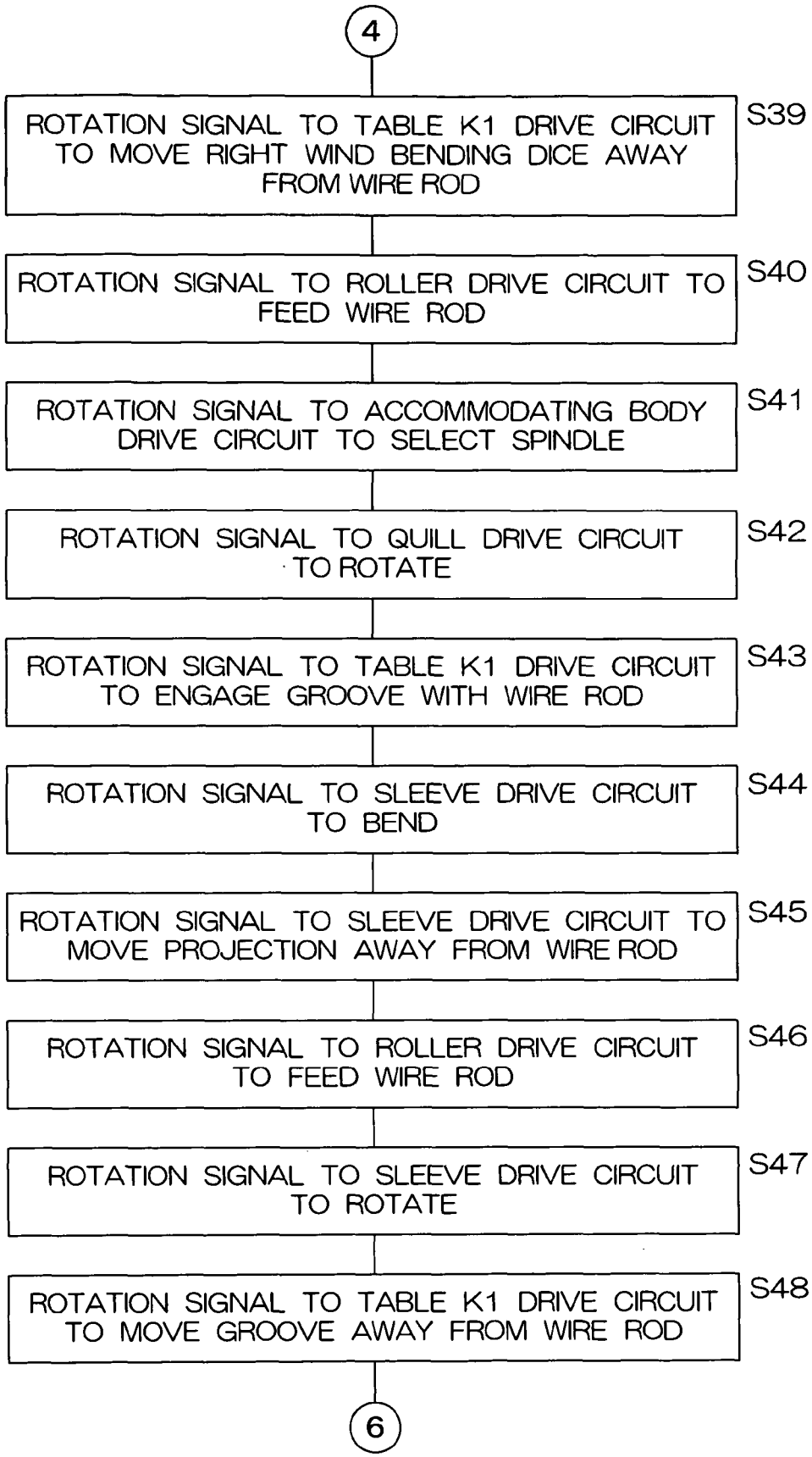
FIG. 32 is a flowchart showing a manufacturing process of a torsion spring by the spring manufacturing apparatus according to the fourth embodiment.
Figure 33:
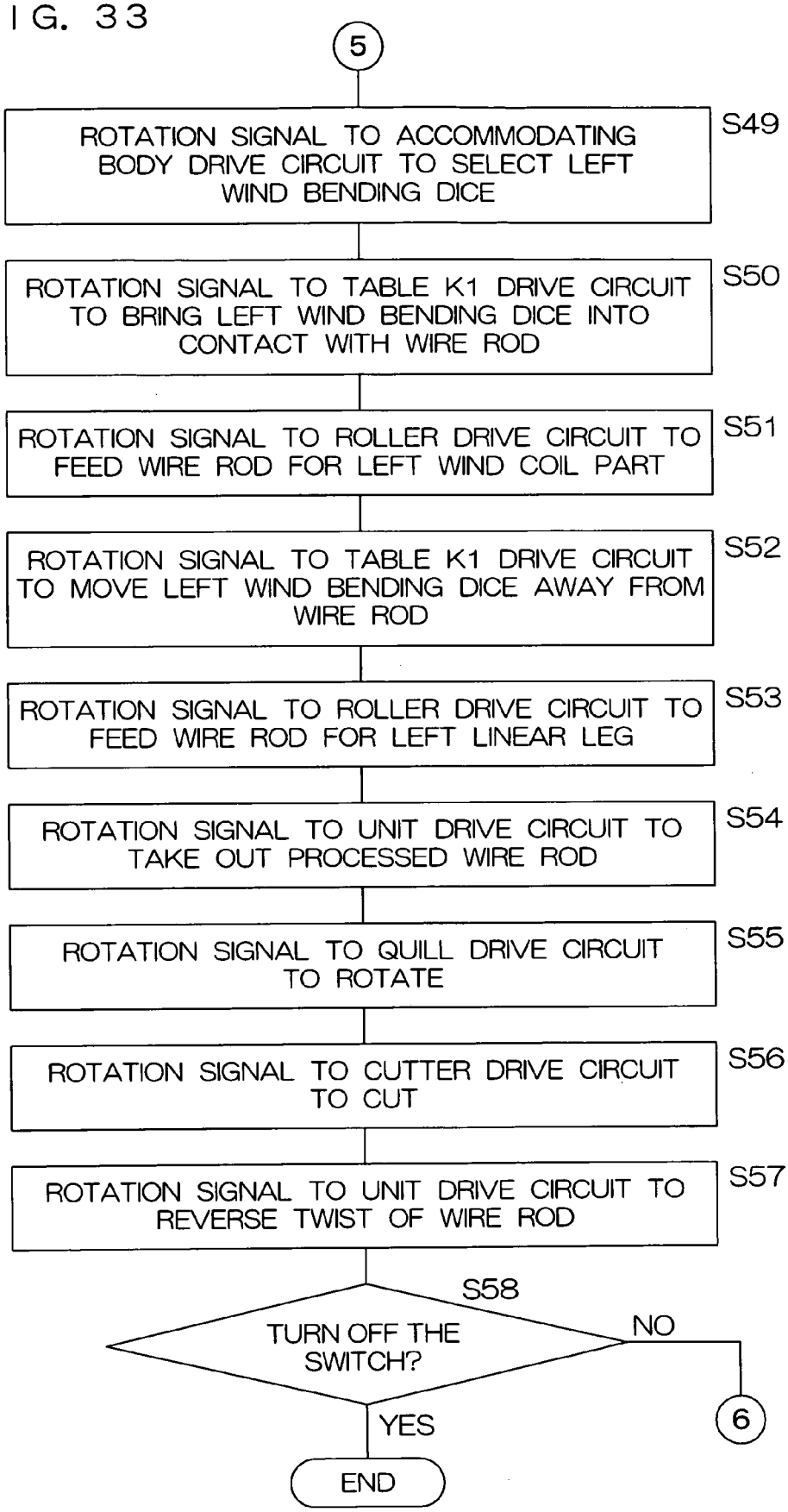
FIG. 33 is a flowchart showing a manufacturing process of a torsion spring by the spring manufacturing apparatus according to the fourth embodiment.

Manufacturing of a torsion spring by the spring manufacturing apparatus according to the fourth embodiment will now be described. FIG. 30 is a block diagram showing a configuration of a control circuit 70 for controlling the rotation of each servo motor and a drive circuit of each servo motor connected to the control circuit 70. FIGS. 31 to 33 are flowcharts showing the manufacturing process of a torsion spring by the spring manufacturing apparatus. FIGS. 34A to 42C are explanatory views for illustrating the movement of the spindle 100, the right wind bending dice 112*a*, and the left wind bending dice 112*b*. FIG. 34A, FIG. 35A, FIG. 36A, FIG. 37A, FIG. 38A, FIG. 39A, FIG. 40A, FIG. 41A, and FIG. 42A are schematic front views; FIG. 34B, FIG. 35B, FIG. 36B, FIG. 37B, FIG. 38B, FIG. 39B, FIG. 40B, FIG. 41B, and FIG. 42B are schematic side views; and FIG. 34C, FIG. 35C, FIG. 36C, FIG. 37C, FIG. 38C, FIG. 39C, FIG. 40C, FIG. 41C, and FIG. 42C are schematically bottom views.

The spring manufacturing apparatus includes an operation unit 60, information necessary for manufacturing a spring such as the dimension of a torsion spring to be manufactured including the length of the right leg, the length of the right winding coil part, the length of the intermediate part, the length of the left winding coil part, and the length of the left leg, the type of tools to be used in manufacturing a torsion spring, the attachment position of the tool, and the like are input by the operation unit 60. The operation unit 60 includes a switch 61 for inputting start and stop of spring manufacturing. A control circuit 70 for controlling the forward-reverse rotation of each servo motor is connected to the operation unit 60. The control circuit 70 includes a CPU for outputting a rotation signal to a drive circuit to be hereinafter described, a ROM for storing a control program for controlling the forward-reverse rotation of the servo motors, a RAM for temporarily storing information input from the operation unit 60, and the like. The control circuit 70 is connected with a movable plate W1 drive circuit 121 for moving the servo motor M1 coupled to the movable plate W1, a table K1 drive circuit 122 for driving the servo motor M9 coupled to the table K1, an accommodating body drive circuit 123 for driving the servo motor M10 coupled to the operation device accommodating body K2, a sleeve drive circuit 124 for driving the servo motor M11 coupled to the outer sleeve, a cutter drive circuit 75 for driving the servo motors M4, M4 of the crank slides 14, 14 holding the cutters, a roller drive circuit 77 for driving the servo motor M6 coupled to the wire rod feeding roller, a unit drive circuit 78 for driving the servo motor M7 coupled to the wire rod feeding unit, and a quill drive circuit 79 for driving the servo motor M8 coupled to the quill 4. The rotation signal is output from the control circuit 70 to each drive circuit to rotate the respective servo motors for a predetermined number of times.

The control circuit 70 determines whether or not all the information necessary for manufacturing a spring such as the dimension of a torsion spring, the type of tool used in manufacturing a torsion spring, the attachment position of the tool, and the like are input by the operation unit 60 (step S31). If all the information necessary for manufacturing the spring are not input (step S31: NO), the process returns to step S1. If all the information necessary for manufacturing the spring are input (step S31: YES), the control circuit 70 determines whether or not the switch 61 is turned ON (step S32). If the switch 61 is not turned ON (step S32: NO), the process returns to step S32. If the switch 61 is turned ON (step S32: YES), a rotation signal is output from the control circuit 70 to the movable plate W1 drive circuit 121, the table K1 drive circuit 122, and the accommodating body drive circuit 123. When the rotation signal is output, the servo motors M1, M9 and M10 are forward-reverse-rotated, and the spindle 100, the right wind bending dice 112*a*, and the left wind bending dice 112*b* move in the XYZ directions to be arranged substantially immediately above the quill 4 (step S33).

Figure 34A:
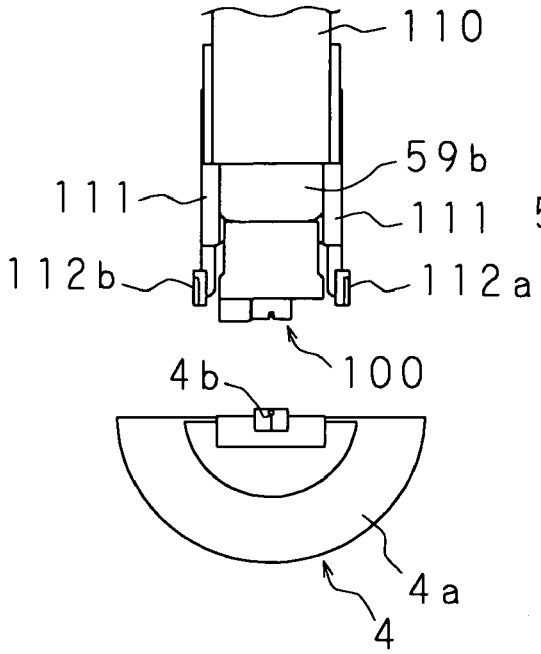
FIGS. 34A, 34B, and 34C are explanatory views for illustrating the movements of the spindle, the right wind bending dice, and the left wind bending dice according to the fourth embodiment.
Figure 34B:
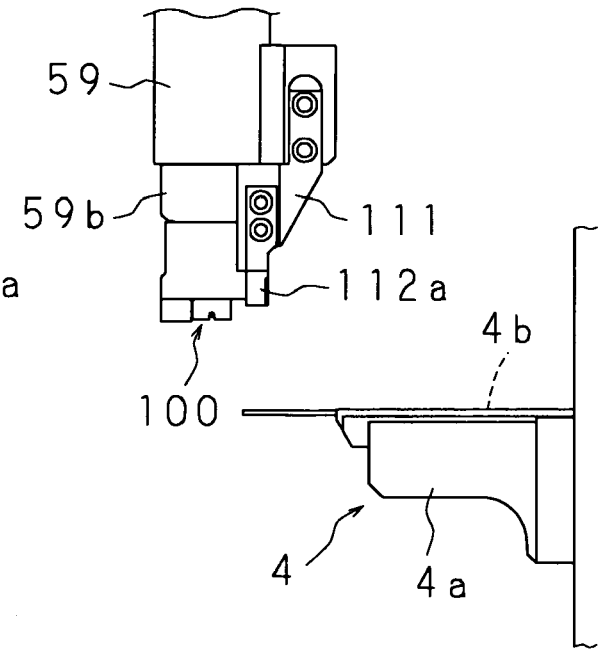
Figure 34C:
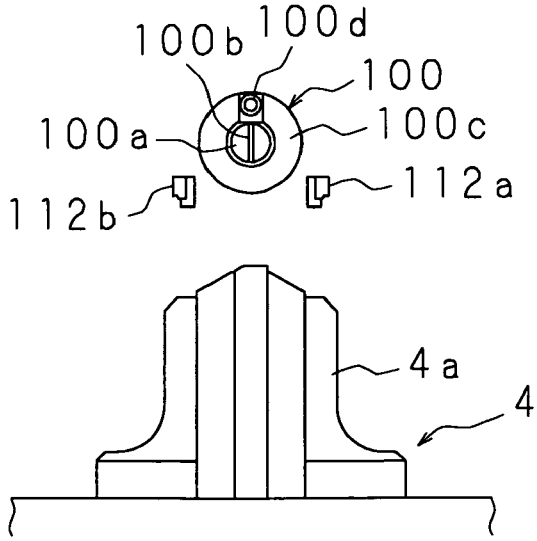
Figure 35A:
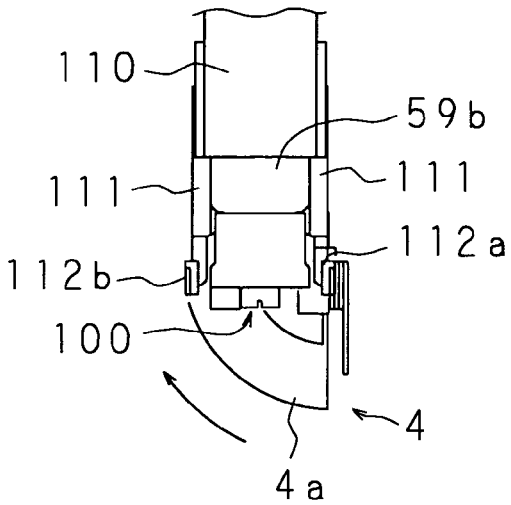
FIGS. 35A, 35B, and 35C are explanatory views for illustrating the movements of the spindle, the right wind bending dice, and the left wind bending dice according to the fourth embodiment.
Figure 35B:
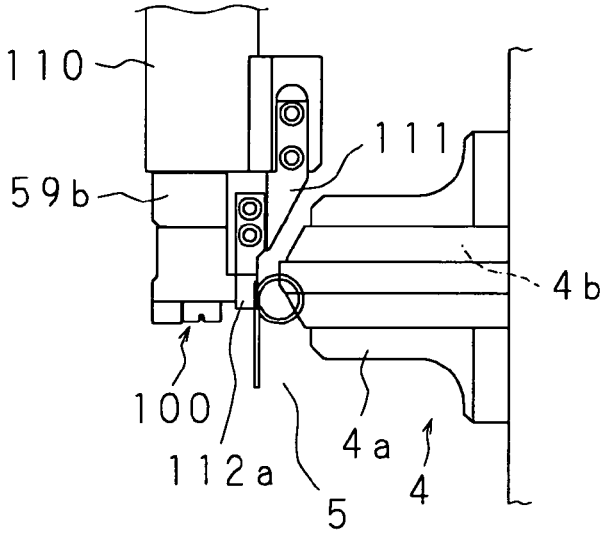
Figure 35C:
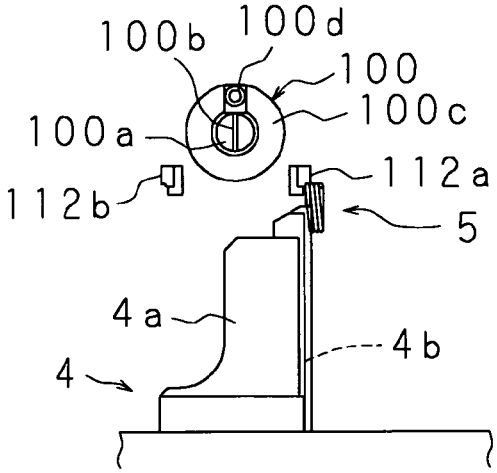
Figure 36A:
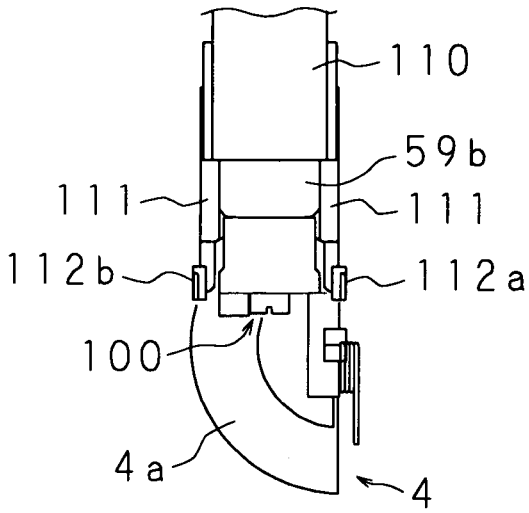
FIGS. 36A, 36B, and 36C are explanatory views for illustrating the movements of the spindle, the right wind bending dice, and the left wind bending dice according to the fourth embodiment.
Figure 36B:
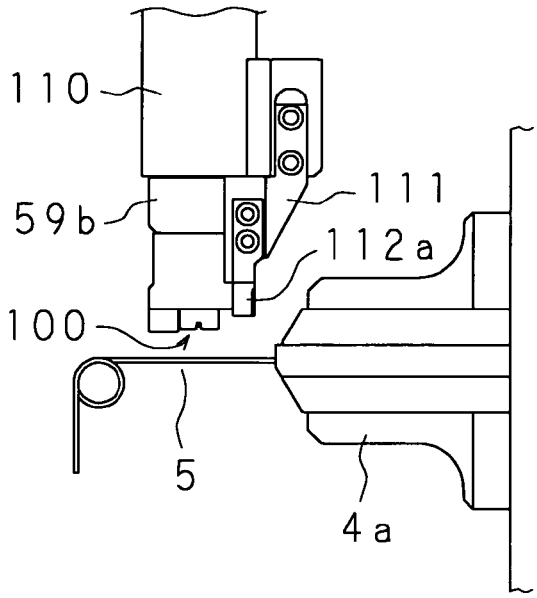
Figure 36C:
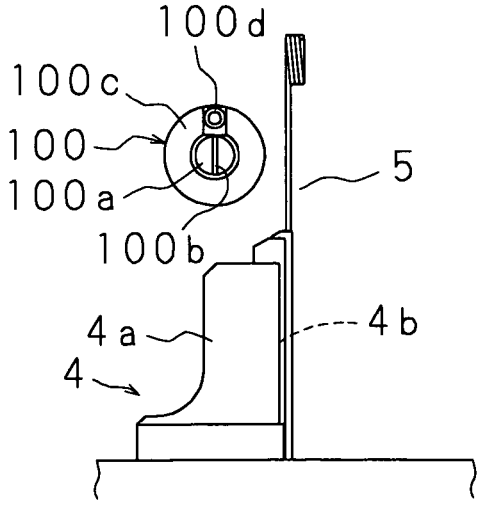
Figure 37A:
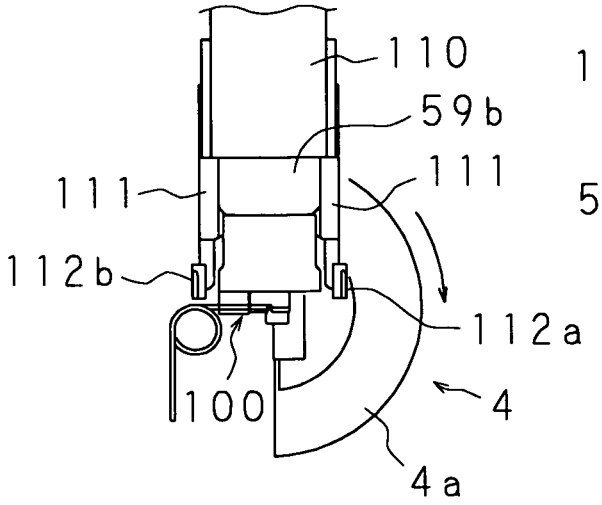
FIGS. 37A, 37B, and 37C are explanatory views for illustrating the movements of the spindle, the right wind bending dice, and the left wind bending dice according to the fourth embodiment.
Figure 37B:
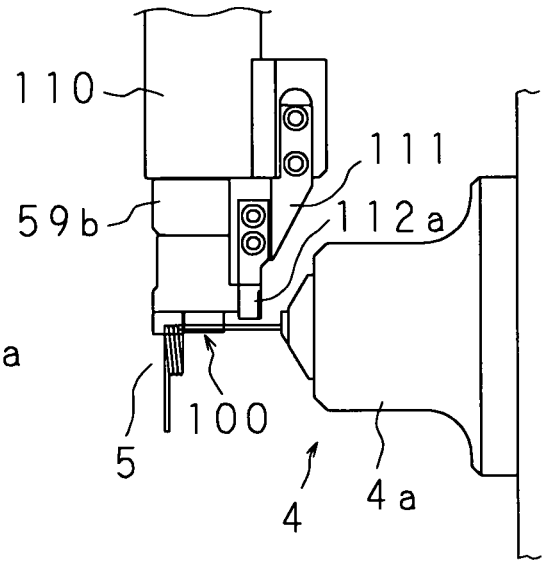
Figure 37C:
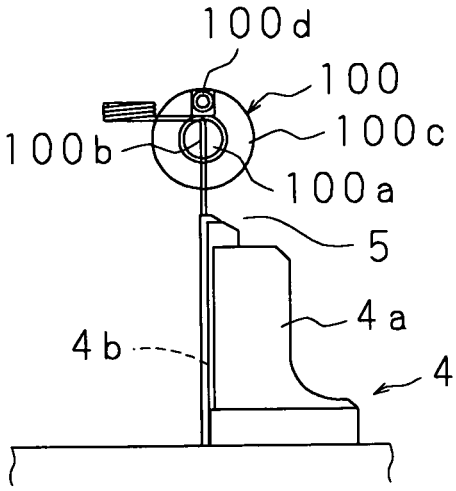
Figure 38A:
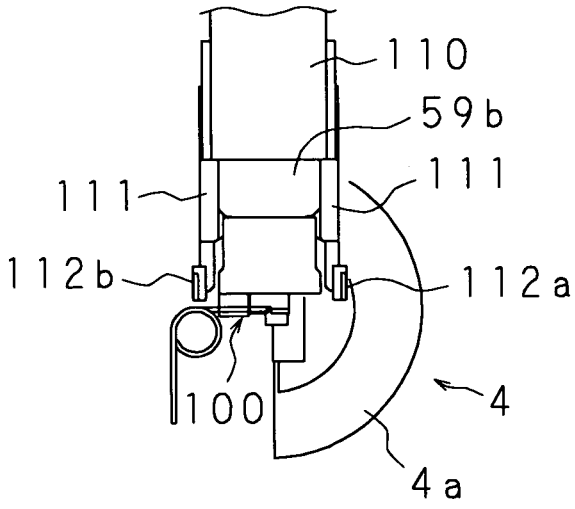
FIGS. 38A, 38B, and 38C are explanatory views for illustrating the movements of the spindle, the right wind bending dice, and the left wind bending dice according to the fourth embodiment.
Figure 38B:
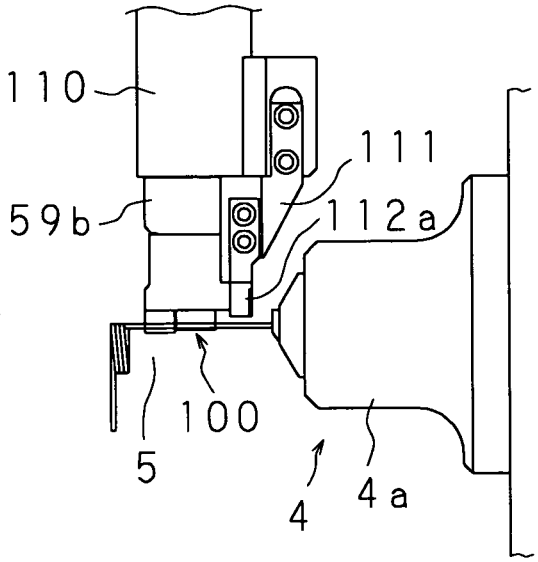
Figure 38C:
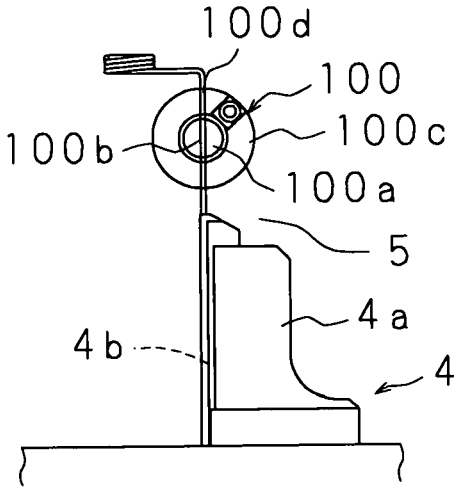
Figure 39A:
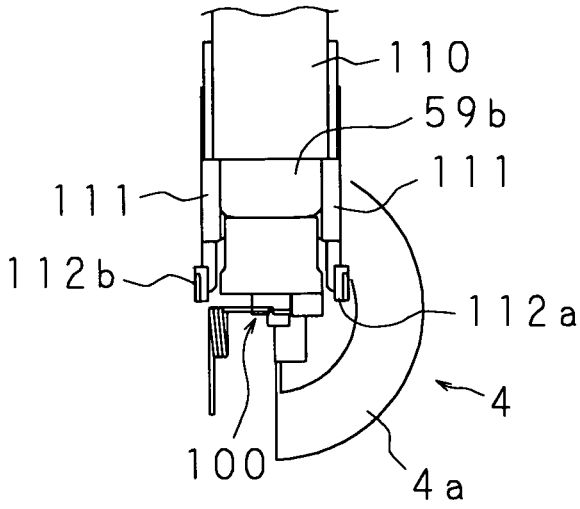
FIGS. 39A, 39B, and 39C are explanatory views for illustrating the movements of the spindle, the right wind bending dice, and the left wind bending dice according to the fourth embodiment.
Figure 39B:
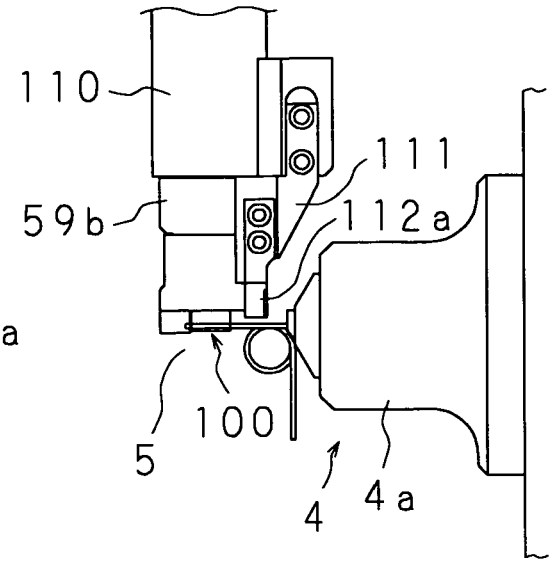
Figure 39C:
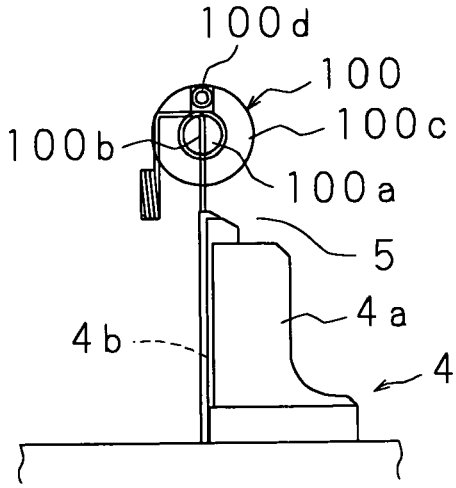
Figure 40B:
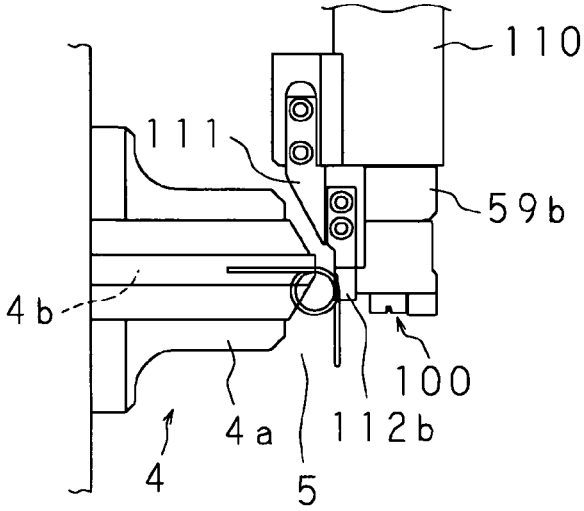
FIGS. 40A, 40B, and 40C are explanatory views for illustrating the movements of the spindle, the right wind bending dice, and the left wind bending dice according to the fourth embodiment.
Figure 40A:
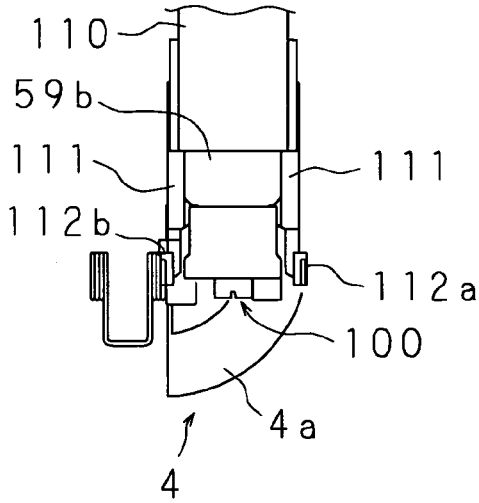
Figure 40C:
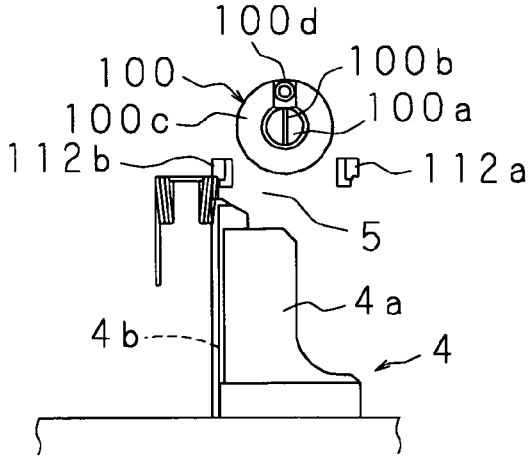
Figure 41B:
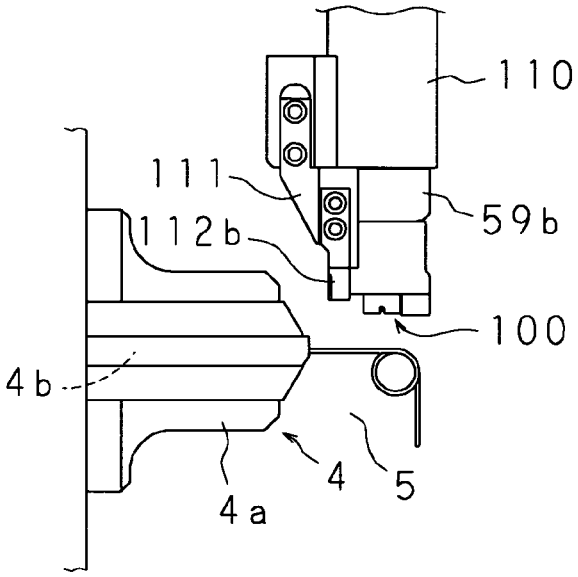
FIGS. 41A, 41B, and 41C are explanatory views for illustrating the movements of the spindle, the right wind bending dice, and the left wind bending dice according to the fourth embodiment.
Figure 41A:
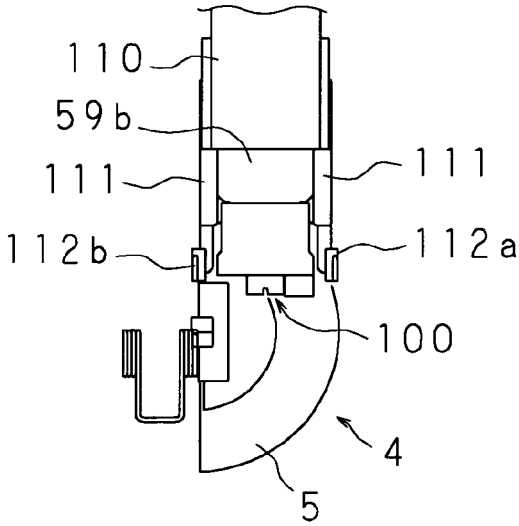
Figure 41C:
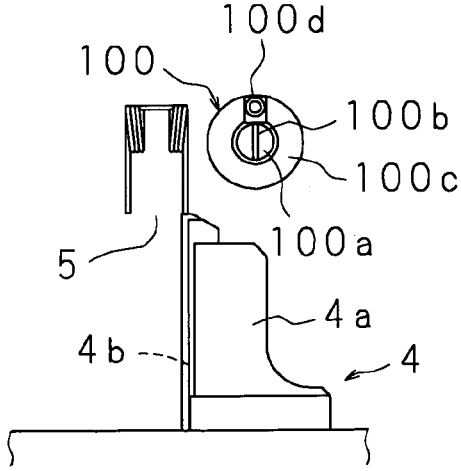
Figure 42B:
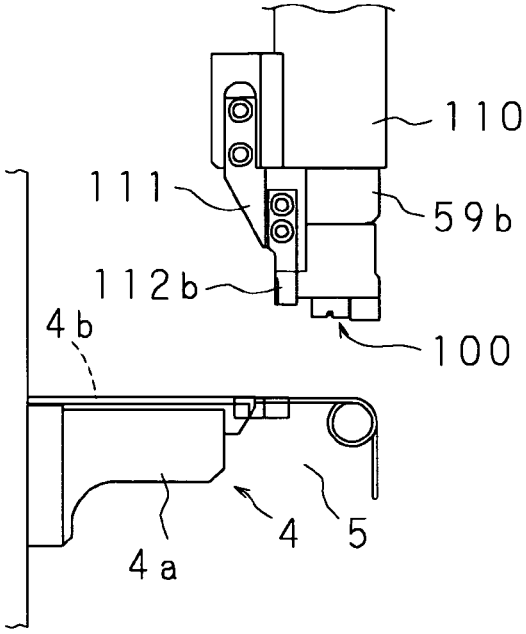
FIGS. 42A, 42B, and 42C are explanatory views for illustrating the movements of the spindle, the right wind bending dice, and the left wind bending dice according to the fourth embodiment.
Figure 42A:
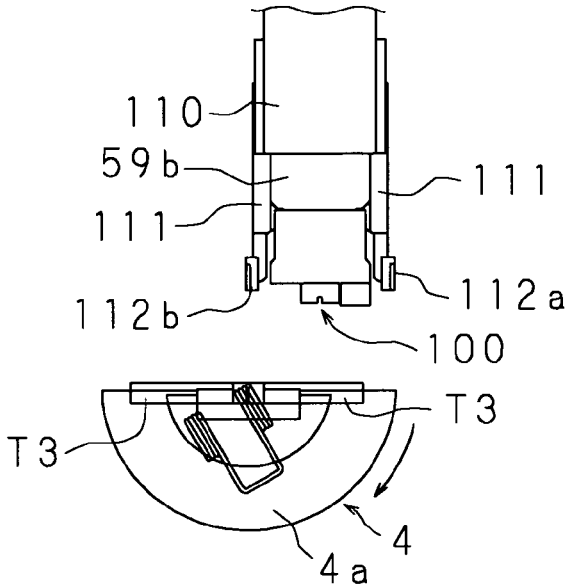
Figure 42C:
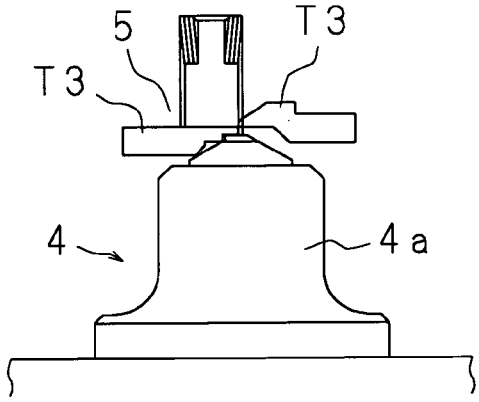

A rotation signal is output from the control circuit 70 to the roller drive circuit 77, so that the servo motor is rotated for a predetermined number of times, the wire rod is fed to the wire rod processing space, and the linear right leg is formed (step S34, see FIGS. 34A to 34C).

A reverse rotation signal is output from the control circuit 70 to the accommodating body drive circuit 123, so that the servo motor is reverse rotated over a predetermined number of times. According to such reverse rotation, the operation device accommodating body K2 moves towards the left along the X-axis direction. The right wind bending dice 112*a* is then arranged immediately above the wire rod, and the right wind bending dice 112*a* is selected (step S35). A rotation signal is output to the quill drive circuit 79, so that the quill 4 is rotated as shown with an arrow of FIG. 35A. The quill 4 is then arranged at a position where it does contact the right winding coil part to be hereinafter described by the rotation (step S36). A forward rotation signal is then output to the table K1 drive circuit 122, so that the servo motor M9 is forward-rotated over a predetermined number of times. According to such forward rotation, the table K1 moves towards the lower side along the Y-axis direction, the right wind bending dice 112*a* contacts the wire rod, and the wire rod bends towards the lower side (step S37). A rotation signal is output from the control circuit 70 to the roller drive circuit 77, so that the servo motor M6 is rotated over a predetermined number of times, and the rod wire is fed to the wire rod processing space 5. The fed wire rod contacts the groove formed in the right wind bending dice 112*a* to be bending-deformed, whereby the right wind coil part is formed (step S38, see FIGS. 35A to 35C).

When the right winding coil part is formed, a reverse rotation signal is output from the control circuit 70 to the table K1 drive circuit 122, so that the servo motor M9 is reveres-rotated over a predetermined number of times. According to the reverse rotation, the right wind bending dice 112*a* moves towards the upper side along the Y-axis, and moves away from the wire rod (step S39). A rotation signal is then output from the control circuit 70 to the roller drive circuit 77, so that the servo motor M6 is rotated over a predetermined number of times, and the wire rod is fed (step S40, see FIGS. 36A to 36C).

When the wire rod is fed, a forward rotation signal is output from the control circuit 70 to the accommodating body drive circuit 123, so that the servo motor M10 is forward-rotated over a predetermined number of times. According to the forward rotation, the operation device accommodating body K2 moves towards the right along the X-axis direction. The spindle 100 is arranged immediately above the wire rod, and the spindle 100 is selected (step S41). A rotation signal is then output to the quill drive circuit 79, so that the quill 4 is rotated as shown with an arrow of FIG. 37A. The quill 4 is then arranged at the position where it does not contact the wire rod folded by the spindle 100, by the rotation (step S42). A forward rotation signal is then output to the table K1 drive circuit 122, so that the servo motor M9 is forward-rotated over a predetermined number of times. According to such forward rotation, the spindle 100 moves towards the lower side along the Y-axis, and the wire rod engages the groove 100*b* in the inner circular column 100*a* (step S43). A forward rotation signal is output from the control circuit 70 to the sleeve drive circuit 124, so that the motor M1 is forward rotated over a predetermined number of times. According to the forward rotation, the outer sleeve 100*c* rotates in the counterclockwise direction, the projection 100*d* contacts the wire rod, and the wire rod bends towards the left side facing the front surface by the corner at the end of the groove 100*b* (step S44, see FIGS. 37A to 37C).

When the wire rod is bent, a reverse rotation signal is output from the control circuit 70 to the sleeve drive circuit 124, so that the servo motor M1 is reverse-rotated over a predetermined number of times. According to the reverse rotation, the outer sleeve 100*c* rotates in the clockwise direction, and the projection 100*d* moves away from the wire rod (step S45). The rotation signal is then output from the control circuit 70 to the roller drive circuit 77, so that the servo motor M6 is rotated over a predetermined number of times, and the wire rod is fed along the groove 100*b* (step S46, see FIGS. 38A to 38C).

When the wire rod is fed, a forward rotation signal is output from the control circuit 70 to the sleeve drive circuit 124, so that the servo motor M11 forward-rotates over a predetermined number of times. According to the forward rotation, the outer sleeve 100*c* rotates in the counterclockwise direction, the projection 100*d* contacts the wire rod, and the wire rod bends towards the left side, facing the front surface by the corner of the groove 100*b*, whereby the intermediate part of horseshoe shape is formed (step S47, see FIGS. 39A to 39C).

When the intermediate part is formed, a reverse rotation signal is output from the control circuit 70 to the table K1 drive circuit 122, so that the servo motor M9 is reverse rotated over a predetermined number of times. According to the reverse rotation, the spindle 100 moves to the upper side along the Y-axis, and the wire rod moves away from the groove 100*b* (step S48). The forward rotation signal is then output to the accommodating body drive circuit 123, so that the servo motor M10 is forward rotated over a predetermined number of times. According to the forward rotation, the operation device accommodating body K2 moves towards the right along the X-axis, and the left wind bending dice 112*b* is arranged immediately above the wire rod, and thus the left wind bending dice 112*b* is selected (step S49). A forward rotation signal is output from the control circuit 70 to the table K1 drive circuit 122, so that the servo motor M9 is forward rotated. According to the forward rotation, the left wind bending dice 112*b* moves towards the lower side along the Y-axis, the left wind bending dice 112*b* contacts the wire rod (step S50), and the wire rod bends towards the lower side. A rotation signal is output from the control circuit 70 to the roller drive circuit 77, so that the servo motor M6 is rotated over a predetermined number of times, and the rod wire is fed. The fed wire rod contacts the groove formed in the left wind bending dice 112*b* to be bending-deformed, whereby the left wind coil part is formed (step S51, see FIGS. 40A to 40C).

When the left winding coil part is formed, a reverse rotation signal is output from the control circuit 70 to the table K1 drive circuit 122, so that the servo motor M9 is reveres rotated over a predetermined number of times. According to the reverse rotation, the left wind bending dice 112*b* moves towards the upper side along the Y-axis, and the left wind bending dice 112*b* moves away from the wire rod (step S52). A rotation signal is then output from the control circuit 70 to the roller drive circuit 77, so that the servo motor M6 is rotated over a predetermined number of times to feed the wire rod, whereby a linear left leg is formed (step S53, see FIGS. 41A to 41C).

When the left leg is formed, a forward rotation signal is output from the control circuit 70 to the unit drive circuit 78, so that the servo motor M7 is forward rotated over a predetermined number of times and the wire rod is twisted in the counterclockwise direction. The right winding coil part is then rotatably moved towards the lower side, and the processed wire rod is taken out from the wire rod processing space 5 (step S54). A rotation signal is then output to the quill drive circuit 79, so that the quill 4 is rotated and the quill 4 is arranged at a position where it does not contact the cutter that has moved to the wire rod processing space 5, as shown with an arrow of FIG. 42A (step S55). A rotation signal is output from the control circuit 70 to the cutter drive circuit 75, so that the servo motor M4 is rotated over a predetermined number of times. According to such rotation, the two cutters T3, T3 move to the wire rod processing space 5 and abut to cut the wire rod, thereby forming a torsion spring (step S56, see FIGS. 42A to 42C).

A reverse rotation signal is then output from the control circuit 70 to the unit drive circuit 78, so that the servo motor M7 is reverse-rotated over a predetermined number of times to rotate the wire rod in the clockwise direction, and the twist of the wire rod is reversed (step S57). Determination is then made on whether or not the switch 61 is turned OFF (step S58). If the switch 61 is turned ON (step S58: NO), the process returns to step S33. If the switch 61 is turned OFF (step S58: YES), the manufacturing of the torsion spring is terminated. The description of the right wind bending dice 112*a* and the left wind bending dice 112*b* is omitted in one part of the figure.

In the spring manufacturing apparatus according to the fourth embodiment, the movable unit K and the tool holder 14*c* that move in the X-axis direction and the Y-axis direction are arranged on the front surface of the supporting body W that moves in the Z-axis direction, and the spindle attachment part 59*b* and the bending dice attachment jigs 111, 111 are arranged on the movable unit K, so that the movable unit K and the supporting body W arranged at the vicinity of the quill 4 can be moved, the relative position of the quill 4 as well as the tool holder 14*c*, the spindle attachment part 59*b*, and the bending dice attachment jigs 111, 111 can be accurately adjusted, and a spring of good precision can be manufactured. In the spring manufacturing apparatus according to the fourth embodiment, a desired spring can be manufactured and miniaturization of the spring manufacturing apparatus can be achieved while avoiding restrictions on the length of the wire rod that can be fed when manufacturing one spring, the folding or the rotation with respect to the wire rod, and the like. Furthermore, in the spring manufacturing apparatus according to the fourth embodiment, a great number of tool holders 14*c*, the spindle attachment part 59*b*, and the bending dice attachment jigs 111 can be arranged at the vicinity of the quill 4. In the spring manufacturing apparatus according to the fourth embodiment, the reactive force generated when the processing tool T contacts the wire rod is absorbed by the entire supporting body W, whereby the durability of the supporting body W can be enhanced. In the spring manufacturing apparatus according to the fourth embodiment, when arranging a plurality of tool holders 14*c*, 14*c* on the supporting body W, and abutting the two processing tools T to process the wire rod, for example, when abutting two cutters T3, T3 to cut the wire rod, the two reactive forces that generate act on opposite directions to each other at the supporting body W and thus are canceled out, whereby the position of the supporting body W can be prevented from being biased.

In the spring manufacturing apparatus according to the fourth embodiment, a plurality of drive sources is respectively coupled to the movable unit K including the table K1 and the operation device accommodating body K2 by way of a transmission member, whereby the table K1 and the operation device accommodating body K2 can be moved in the X-axis direction and the Y-axis direction, respectively, the relative position of the quill 4 and the processing tool T can be accurately adjusted, and the spring of satisfactory precision can be manufactured.

In the spring manufacturing apparatus according to the fourth embodiment, the servo motors M6, M7, and M8 are respectively coupled to the wire rod feeding roller 30, the housing 31, and the quill 4 by way of the transmission member, whereby the wire rod feeding roller 30, the housing 31, and the quill 4 can be rotated about the axial core of the wire rod. The wire rod can be rotated with the rotation, so that the processing tool T is avoided from contacting the portion of the wire rod processed to a spring, and the avoided wire rod can be prevented from contacting the quill 4.

In the spring manufacturing apparatus according to the fourth embodiment, the movable unit K that moves in the X-axis direction and the Y-axis direction is arranged at the vicinity of the opening W1*a* at the front surface of the supporting body W, the spindle operation device 59 is arranged on the movable unit K, the movable unit K and the spindle operation device 59 are arranged on the Y-axis, the spindle attachment part 59*b* and the bending dice attachment jigs 111, 111 are arranged at the portion on the quill 4 side of the spindle operation device 59, and the spindle 100, the right wind bending dice 112*a* and the left wind bending dice 112*b* are attached along the X-axis direction, so that the movable unit K is moved in the X-axis direction, the necessary processing tool T is selected from the spindle 100, the right wind bending dice 112*a*, and the left wind bending dice 112*b*, and the number of members for selecting the processing tool T such as the turret and the servo motor for rotating the turret can be saved, and the number of tool holders can be reduced.

In the spring manufacturing apparatus according to the fourth embodiment, the right wind bending dice 112*a* and the left wind bending dice 112*c*, and the spindle 100 for bending the wire rod are arranged at the Z-axis side portion, so that a coil portion is formed using the right wind bending dice 112*a* and the left wind bending dice 112*b*, and a bent portion is formed using the spindle 100 thereby manufacturing a torsion spring.

The movable unit K and the spindle operation device 59 are arranged on the X-axis, the spindle attachment part 59*b* and the bending dice attachment jigs 111, 111 are arranged at the portion on the quill 4 side of the spindle operation device 59, and the spindle 100, the right wind bending dice 112*a* and the left wind bending dice 112*b* are attached along the Y-axis direction, so that the movable unit K is moved in the Y-axis direction, and the necessary processing tool T is selected from the spindle 100, the right wind bending dice 112*a*, and the left wind bending dice 112*b*. Since two reactive forces that generate when processing the wire rod are canceled out, a configuration of abutting and pressing the two processing tools may be used.

The configurations of the spring manufacturing apparatus according to the fourth embodiment similar to the configurations of the first to the third embodiments are denoted with the same reference numerals, and the detailed description thereof will be omitted.

As this invention may be embodied in several forms without departing from the spirit of essential characteristics thereof, the present embodiments are therefore illustrative and not restrictive, since the scope of the invention is defined by the appended claims rather than by description preceding them, and all changes that fall within metes and bounds of the claims, or equivalence of such metes and bounds thereof are therefore intended to be embrace by the claims.

What is claimed is:

1. A spring manufacturing apparatus comprising:

a wire rod feeding unit which includes wire rod feeding rollers and feeds a wire rod;

a quill which guides the wire rod fed from the wire rod feeding unit;

a supporting plate for supporting the quill;

a plurality of tool holders holding respectively a plurality of processing tools which process the wire rod to a spring;

a supporting body which supports the tool holders and includes at least one of an X-axis movable body which moves in an X-axis direction, a Y-axis movable body which moves in a Y-axis direction, or a Z-axis movable body which moves in a Z-axis direction of a XYZ orthogonal coordinate system representing a moving direction of the wire rod fed from the wire rod feeding unit as the Z-axis;

an opening, formed in the supporting body, in which the quill is arranged; and a box to which the supporting plate is fixed, wherein the tool holders are radially arranged around an opening at the center of the front surface of the supporting body, wherein the quill, which is supported by the supporting plate, is inside the opening, wherein the supporting body includes the Z-axis movable body, wherein the apparatus further comprises a Z-axis movable body driving source which drives the Z-axis movable body to move the supporting body in the Z-axis direction, wherein the opening is cut out in an arch shape, and wherein the supporting plate is inside the opening and forms a shape corresponding to the arch shape.

* * * * *